US005217215A

United States Patent [19]

Ohata et al.

[11] Patent Number: 5,217,215

[45] Date of Patent: Jun. 8, 1993

[54] SORTER AND STAPLER WITH ROTATING GATE

[75] Inventors: Yousuke Ohata, Osaka; Yukio Hashimoto, Hirakata; Hidekazu Sakagami, Kobe; Toshinori Nishimura, Hirakata; Tsuyoshi Nagao, Osaka, all of Japan

[73] Assignee: Mita Industrial Co., Ltd., Japan

[21] Appl. No.: 764,702

[22] Filed: Sep. 24, 1991

[30] Foreign Application Priority Data

| | | | |
|---|---|---|---|
| Sep. 28, 1990 | [JP] | Japan | 2-262370 |
| Oct. 19, 1990 | [JP] | Japan | 2-282997 |
| Oct. 19, 1990 | [JP] | Japan | 2-282998 |

[51] Int. Cl.[5] ..... B42B 2/00; B65H 39/02; B65H 31/04

[52] U.S. Cl. ..... 270/53; 270/58; 271/293; 271/294; 271/213; 271/221

[58] Field of Search ..... 270/53, 37, 58; 271/213, 292, 293, 294, 221

[56] References Cited

U.S. PATENT DOCUMENTS

| | | | |
|---|---|---|---|
| 3,536,318 | 10/1970 | Gay et al. | 270/53 X |
| 3,866,904 | 2/1975 | Stemmle | 271/293 X |
| 4,095,782 | 6/1978 | Breuers et al. | 271/292 |
| 4,385,827 | 5/1983 | Naramore . | |
| 4,721,229 | 1/1988 | Dempf et al. | 271/213 X |
| 4,917,364 | 4/1990 | Iida et al. | 270/37 |
| 4,928,150 | 5/1990 | Hatta . | |
| 4,946,152 | 8/1990 | Ishikawa et al. | 270/53 |
| 4,988,085 | 1/1991 | Maekawa et al. | 270/53 |
| 5,005,751 | 4/1991 | Radtke et al. | 270/53 X |
| 5,037,077 | 8/1991 | Kubota et al. | 270/53 |
| 5,092,509 | 3/1992 | Naito et al. | 270/53 X |

FOREIGN PATENT DOCUMENTS

| | | | |
|---|---|---|---|
| 143853 | 8/1984 | Japan | 271/221 |
| 230960 | 12/1984 | Japan | 271/293 |
| 60-179756 | 9/1985 | Japan . | |
| 147775 | 6/1988 | Japan | 271/293 |
| 63-165270 | 7/1988 | Japan . | |
| 1-231757 | 9/1989 | Japan . | |
| 2-23154 | 1/1990 | Japan . | |

*Primary Examiner*—Edward K. Look
*Assistant Examiner*—John Ryznic
*Attorney, Agent, or Firm*—Beveridge, DeGrandi, Weilacher

[57] ABSTRACT

A sorter incorporating a stapler is an apparatus for sorting and stapling sheets discharged from an image forming apparatus. This sorter includes a plurality of vertically movable bins for storing the supplied sheets, a bin drive unit for conveying the bins, a stapler for stapling the sheets stored in the bins, a pair of lateral guides, and a lateral guide drive unit for moving the lateral guides. The lateral guides are movable in the width direction of the sheets in the bins and abut on both sides of stacks of the sheets to arrange them into widthwise adjustment, and then to move them into the stapling position of the stapler.

32 Claims, 17 Drawing Sheets

SORTER AND STAPLER WITH ROTATING GATE

BACKGROUND OF THE INVENTION

The present invention relates to a sorter, and more specifically, it relates to a sorter which incorporates a stapler capable of stapling a stack of sheets.

A conventional copying machine may have a sorter for stacking the sheets from its image-developing process in a given order. One type of sorter includes a stapler for stapling each stack of sheets.

Japanese Patent Laying-Open No. 231757/1989 discloses one of the conventional sorters which has a stapler. The sorter has a plurality of bins for receiving sheets so as to sort them into a given order. The bins are disposed vertically and capable of moving vertically. A discharger is provided near the lowest end of the bins for the transport of sheets from a copying machine into the bins. A stapler for stapling the stacks of sheets stored in each bin is provided in the discharger.

In the conventional sorter, there is a predetermined gap between respective adjacent bins through which sheets are transported from the discharger into the bins. The stack of sheets stored in a bin is stapled by the stapler. The stapler can be rotated through a predetermined angle such that the stapler is located either in a drawn position, allowing the bins to pass, or in a stapling position, in which stapling operation is performed.

Japanese Patent Laying-Open No. 23154/1990 discloses another sorter which has a plurality of bins each of which is immovable. Sheets from a copying maching are transported by a transport mechanism which includes claws provided to correspond to the bins. In the sorter is a stapler which is vertically movable.

The stapling operation of the sorter is performed as follows: the stapler is moved vertically; a pincher draws the stack of sheets in a bin into a stapling position; the stapler staples the stack of sheets; and the pincher moves the stack back into the bin.

In the sorter disclosed in Japanese Patent Laying-Open No. 231757/1989, the stapler is disposed in the discharger, wherein the stapler is an obstruction to bins moving vertically. Consequently, a mechanism to rotate the stapler between the stapling position and the drawn position must be provided, complicating the structure. In the sorter disclosed in Japanese Patent Laying-Open No. 23154/1990, a device for drawing a stack of sheets out from a bin and moving the stack back into the pin must be provided in addition to the stapler, thus also complicates the structure of the sorter.

The above-described sorters, however, cannot accommodate any number of stacks of stapled sheets greater than the number of bins. Therefore, when a larger number of copies are to be produced, an operator must empty stapled sheets from the bins in order to allow succeeding sheets to pass into the bins. A plurality of sorters could be provided, in order to process a larger number of copies, but they would occupy a greater amount of space.

Japanese Patent Laying-Open No. 165270/1988 discloses a sorter consisting of a sorting portion and a stacking portion. When sheets are to be stapled by the sorter, stacks formed in the sorting portion are transported to the stacking portion, and then a stapler provided in the stacking portion staples the stacked sheets. Accordingly, the sorter can handle a number of copies larger than the number of bins provided in the sorting portion.

In the sorter, however, the stacks of sheets formed in the sorting portion become disarranged while they are transported toward the stacking portion, making it difficult to rearrange the stacks of sheets in the stacking portion before stapling.

Japanese Patent Laying-Open No. 179756/1985 discloses a sorter in which each bin is sloped, positioning the sheet-forward ends higher than the opposite ends, whereby stacks of stapled sheets can then be readily discharged into a storing portion. In the sorter, a sheet fed from the discharging portion of a copying machine automatically slides to a stop located at an end of each bin by its own weight. However, sheets of smaller size may easily stick in the middle of a bin. In such a case, the ends of all of the sheets cannot be arranged into adjustment, and the stapling operation cannot be performed satisfactorily. When the length of the sheets is much shorter than that of the bins, the leading edge of one sheet may knock against the trailing edge of the preceding sheet, or one sheet may be transported under the preceding sheet. This results in a stapling of inferior quality at times.

SUMMARY OF THE INVENTION

It is an object of the present invention to provide a sorter which incorporates a simple stapler.

It is another object of the present invention to provide a sorter incorporating a stapler which is capable of stapling a given number of sheet stacks greater than the number of bins, and storing the stapled sheets by means of a simple mechanism.

It is a further object of the present invention to provide a sorter incorporating a stapler which is compact and is capable of stapling a given number of sheet stacks greater than the number of bins.

It is another object of the present invention to provide a sorter incorporating a stapler which is capable of suitably arranging sheets well within bins and stapling a given number of sheet stacks greater than the number of bins.

A sorter according to the present invention includes a paper storage, a stapler, and a pair of lateral guides.

The paper storage stores supplied paper. The stapler staples the paper stored in the paper storage. The lateral guides are movable in the width direction of the paper stored in the paper storage so as to adjust the stored paper in the width direction by abutting on both sides of the paper, and to move a stack of the paper into the stapler's stapling position at the time of a stapling operation.

In the sorter, supplied sheets are stored in the paper storage. Then, the lateral guides move to correspond to the paper size wherein the lateral guides abut on both sides of the sheets so as to adjust the sheets in the width direction. After a predetermined number of sheets have been stored into the paper storage, the lateral guides move toward the stack of sheets to grip the stack, and then the lateral guides move the stack into the stapling position in the stapler. The stapler then staples the stack of sheets. Afterward, the stapled stack of sheets is moved back into the paper storage by the lateral guides.

Since the stack of paper in the paper storage is thus transferred into the stapling position by the lateral guides, the sorter does not require other particular means in order to do so. Furthermore, since the stack of sheets is transferred into the stapling position, the stapler can be disposed in a position wherein it is not an obstacle to the movement of paper storage. Accordingly, the sorter does not require any stapler-moving devices.

A sorter according to another aspect of the present invention has a plurality of paper storages, a stapler, a rotating mechanism and a stocker.

The paper storages store supplied sheets and are disposed such that they are movable in the vertical direction. In each paper storage, the forward end portion, on which the leading edge of a sheet is positioned, is higher than the back end portion, on which the trailing edge of a sheet is located, and the back end portion includes a rotatable stop for retaining sheets. The stapler is an apparatus for stapling the stacks of sheets stored in the paper storages. The rotating mechanism rotates the stop, whereby a stapled stack of sheets is discharged from a paper storage when the paper storage is positioned at a predetermined location. The stacker receives stacks of sheets dropping from the paper storages.

In the sorter, supplied sheets of paper are stored in the paper storages in a given order. After a predetermined number of sheets are stored in the paper storages, the stapler staples each stack of paper from the respective paper storage. Since the paper storages slope, a sheet stack will abut on the stop provided in the back end portion of a paper storage. Accordingly, when a paper storage is moved so as to be positioned in the predetermined location, the stop rotates to allow the stack of sheets to slide down along the slope of the paper storage. The stack of sheets dropping from the paper storage is received into the stocker.

Consequently, sheet stacks more than the number of paper storages can be handled in the sorting and stapling operations, whereby the sorting and stapling operations of a great number of sheets can be carried out in a short period of time. Additionally, since a stapled stack of sheets drops into the stacker through its own weight when the stopper rotates, the sorter does not require any sort of complex mechanism in order to discharge the stacks of sheets.

A sorter according to another aspect of the present invention is to be located beside an image forming apparatus, and has a sorting part, a transportation path, a stapler and a stacker.

The sorting part stores sheets discharged from the image forming apparatus in a given order. The transportation path is provided between the image forming apparatus and the sorting part, so as to transport the sheets to the sorting part. The stapler staples the stacks of sheets stored in the sorting part. The stacker is located below the transportation path for receiving the stapled stack of sheets.

In the sorter, sheets discharged from the image forming apparatus are supplied to the sorting part through the transportation path so as to arrange them in a given order in the sorting part. The stapler staples stacks of sheets stored in the sorting part and then they are moved into the stacker below the transportation path.

Consequently, the sorter is capable of performing its operation, including stapling, in accordance with a number of sheet stacks which may be greater than the number of sheet storages provided in the sorting part. Furthermore, since the stacker is located in an open space below the transportation path which previously has not been effectively used, the sorter remains compact.

A sorter according to another aspect of the present invention has a plurality of sheet storages, a stapler, a position changer and a stacker.

The sheet storages are disposed vertically and are vertically movable. The sheet storages store supplied sheets. In each sheet storage, the forward end portion, on which the leading end of a sheet is located, is positioned higher than the back end portion, on which the trailing edge of the sheet is positioned, such that the sheet storages slope. The stapler staples each of the sheet stacks stored in the plurality of sheet storages. The position changer reverses the orientation of the sheet storages such that the forward end portion is positioned lower than the back end portion. Thus, a stapled stack of sheets is discharged from the forward end portion of a sheet storage. The stacker receives the stack of sheets discharged from the sheet storage.

In the sorter, the sheet storages slope such that their forward end portions are located higher than their back end portions. Consequently, sheets discharged from the image forming apparatus are arranged so that the trailing edges of the sheets are even with one another, and the leading edge of any one sheet does not abut the trailing edge of the preceding sheet. As a result, stored sheets in the sheet storages are properly arranged. The stacks of sheets stored in the sheet storages are stapled by the stapler.

The stacks of sheets remain in the sheet storages even after they have been stapled. Then, the position changer changes the position of the sheet storages so that the back end portions of the storages are positioned higher than the forward end portions. As a result, stapled stacks of sheets drop from the second end portion of the sheet storages through their own weight, and the stacker receives the stacks of sheets.

Accordingly, since the sheets are stored in the sheet storages with their ends even, are stapled by the stapler, and then are dropped toward the stacker by means of shifting the position of the sheet storages, the sorter does not require any complicated mechanisms for discharging the stacks of sheets from the sheet storages.

These and other objects and advantages of the present invention will be more fully apparent from the following detailed description.

DESCRIPTION OF THE PREFERRED EMBODIMENTS

First Embodiment

Figure 1:
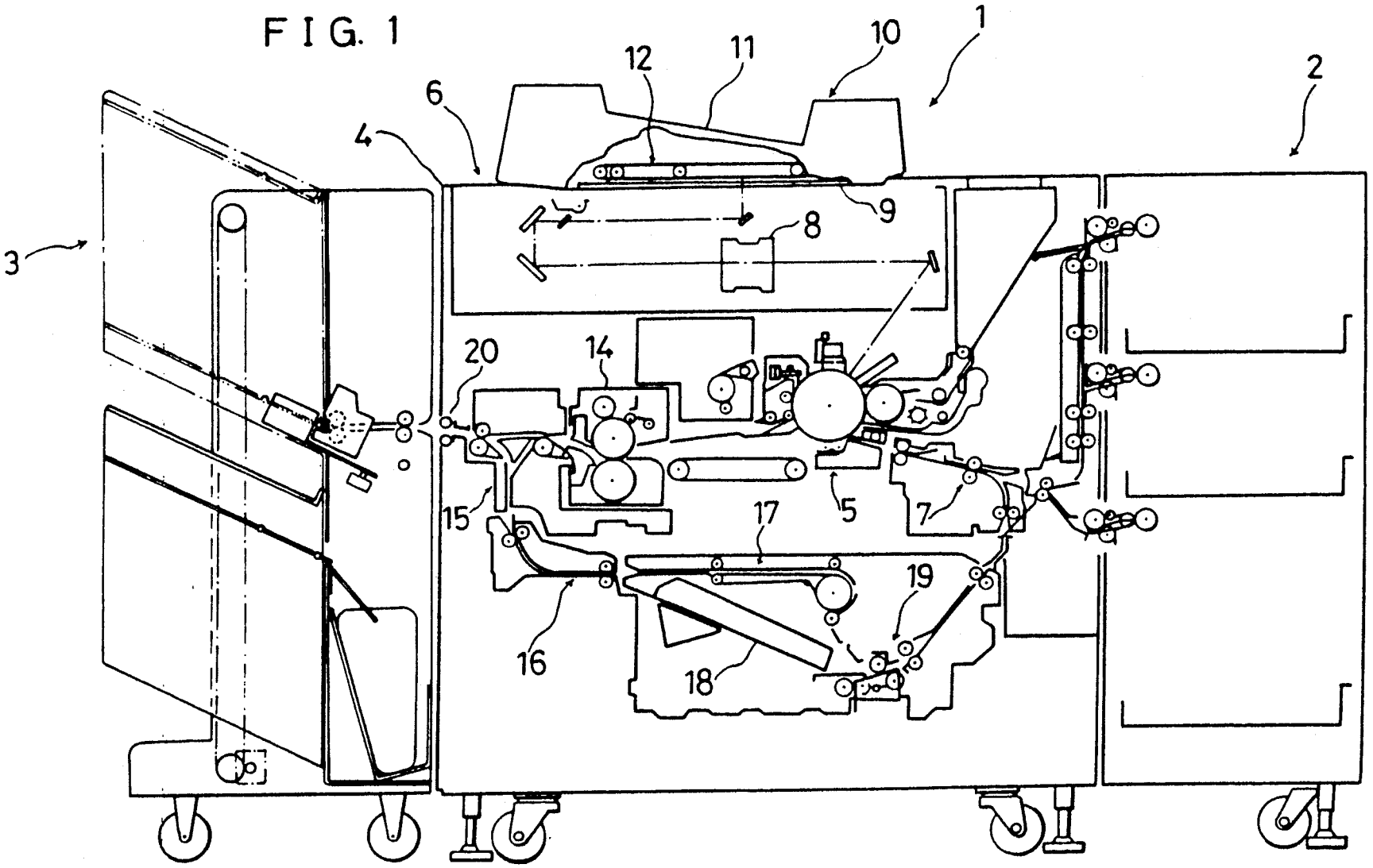
FIG. 1 is a schematic section view of a copying machine equipped with a sorter incorporating a stapler according to the first embodiment of the present invention.

FIG. 1 shows a copying machine equipped with a sorter which incorporates a stapler according to the first embodiment of the present invention.

Referring to FIG. 1, the copying machine includes a main body 1, a paper feeding unit 2 fixed on the right side of the body 1 in the figure, and a sorter 3 located on the left side of the body 1. The body 1 has a case 4, an image forming part 5 disposed in a central portion of the case 4, an original scanner 6 disposed above the image forming part 5, and a paper-transport path 7 for feeding and discharging paper to and from the image forming part 5.

The image forming part 5 has a photoconductive drum disposed at the center, and a charger, a developing unit, a transfer unit, a detach unit, and a cleaning unit disposed surrounding the photoconductive drum.

The original scanner 6 has an optical exposure system 8 disposed above the image forming part 5, an original retainer 9 disposed over the optical exposure system 8, and an automatic original-transport device 10 provided on the original retainer 9. The automatic original-transport device 10 has an original-receiving portion 11 in an upper surface of its case, and an original transporting unit 12 consisting of an original-transport belt and related elements disposed inside the case.

The paper-transport path 7 includes a paper feeding path provided between the paper feeding unit and the image forming part, and a paper discharging path provided beyond the image forming part. A fixing unit 14 is provided in the paper discharging path. Between the fixing unit 14 and the sorter 3, there are discharge rollers 20 for discharging paper to the sorter 3, and a reversing device 15 for reversing the paper.

Provided in a lower portion of the case 4, are a lower transport path 16 which transports paper from the reversing device 15 so that it may be stored, a turning unit 17 for turning round the paper transported through the lower transport path 16, a temporary storage tray 18 for temporary storage of the paper, and a paper refeeding part 19 for transporting the paper from the tray 18.

Figure 2:
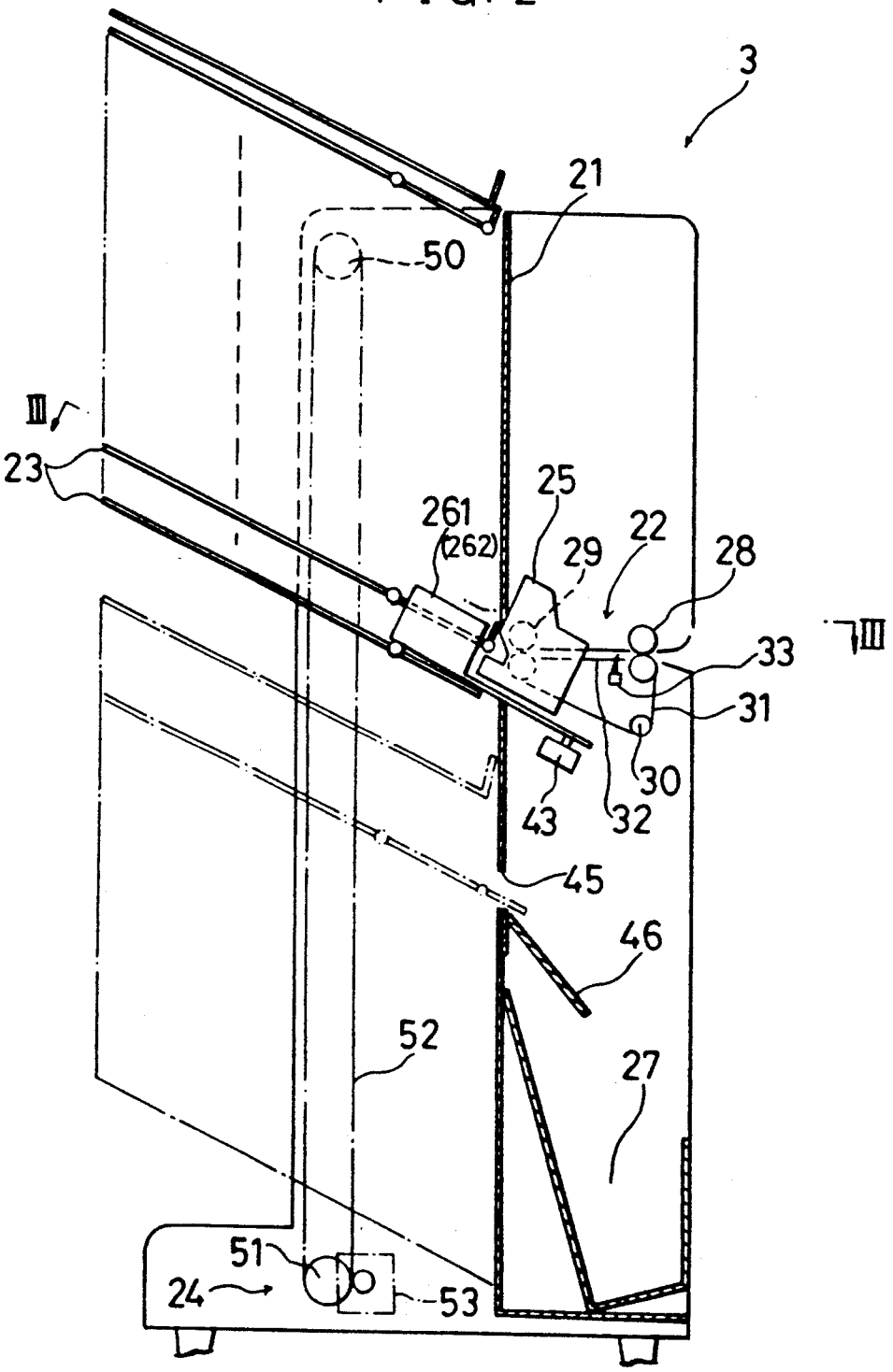
FIG. 2 is a schematic section view of the sorter shown in FIG. 1.

Referring to FIG. 2, the sorter 3 includes primarily a transport path 22 provided on the right side of a partition frame 21, a plurality of bins 23 arranged vertically on the left side of the partition frame 21, a bin driving system 24 for driving the bins 23, a stapler 25 for stapling stacks of sheets sorted into the respective bins 23, a pair of lateral guides 261 and 262 located at essentially the same level as the stapler 25, and a stacker 27 disposed under the transport path 22 for storing stapled stacks of sheets.

The transport path 22 discharges sheets sent by the discharge rollers 20 from the body 1 of the copying machine (shown in FIG. 1) into the respective bins 23. This transport path 22 includes transport rollers 28, discharge rollers 29, a transport motor 30, a belt 31 extending around the rollers 28, 29 and the transport motor 30, and a pair of guide plates 32 for guiding the transported paper. A paper detection switch 33 which detects incoming paper is provided near the transport rollers 28.

The paper storage bins 23, and the lateral guides 261 and 262 which abut both sides of the paper while conveying it, will be described with reference to FIGS. 2 and 3.

Each of the bins 23 has a main tray 35, and a slidable tray 36 provided along the entrance side of the main tray 35. The dimension of the slidable tray 36 in the width direction (vertical direction in FIG. 3) is made less than the minimum size of paper which can be handled in the sorter 3. The slidable tray 36 is coupled to the main tray 35 by means of a rod 37 provided at the paper-incoming end of the main tray 35 so as to be movable in the width direction of the paper. The slidable tray 36 is driven toward the rear of the apparatus (or upwards in FIG. 3) by a spring 38 fitted over the rod 37, wherein it is centered along the width of the discharged paper when the tray is free. The plurality of bins 23 thus constructed are arranged vertically at prescribed intervals. Together the bins 23 as a battery are vertically movable along guide slots formed in a main frame 39. As shown in FIG. 2, each bin 23 is sloped such that the end corresponding to the leading edge of a fed sheet is positioned higher than the end corresponding to the trailing edge of a fed sheet.

Figure 4A:
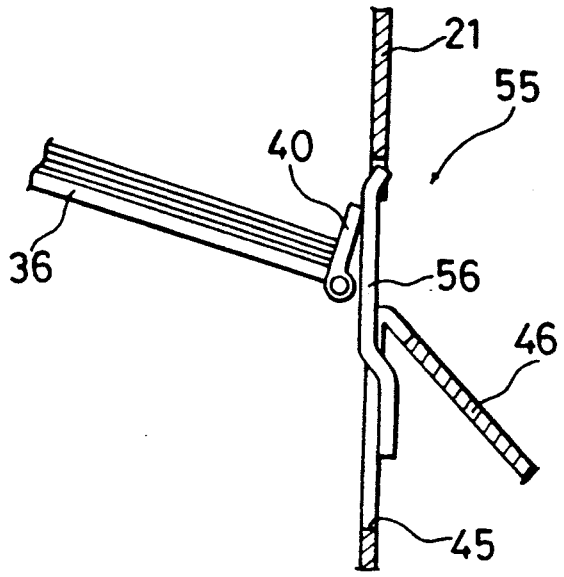
FIGS. 4A and 4B are partial section views showing a shutter mechanism of the sorter in operation.
Figure 4B:
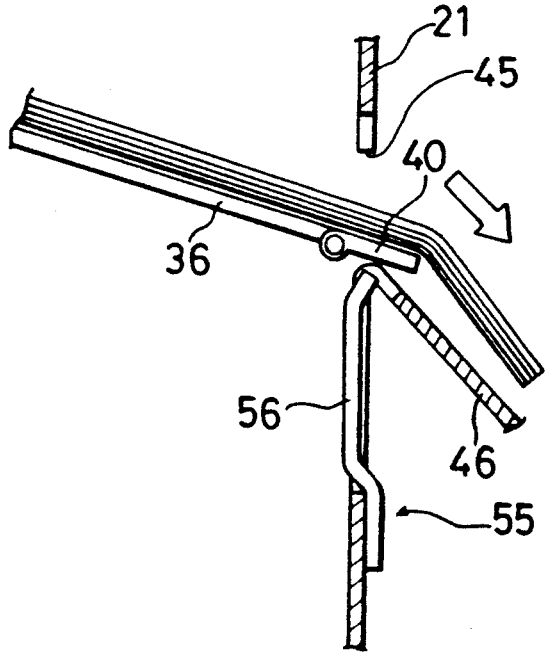

The slidable tray 36 of each bin 23 includes a paper stop 40 along the side of the tray adjacent to the discharge rollers 29. The paper stop 40 is rotatable between a paper stop position, wherein it stands at essentially a right angle to the paper-retaining surface of the slidable tray 36, as shown in FIG. 4A, and a paper discharge position, wherein it is in the same plane as the paper-retaining surface of the slidable tray 36, as shown in FIG. 4B. The paper stop 40 is impelled clockwise in FIG. 4A by means of a spring not shown. When the paper stop 40 is located in the paper stop position, the sheets of paper abut against the paper stop 40 due to their weight, whereby the trailing edges of the sheets are evened with each other. When the paper stop 40 rotates and is located in the paper discharge position, the paper stop 40 serves as a guide plate for smoothly guiding a stack of paper into the stacker 27. In the end of the slidable tray 36 adjacent to the discharge rollers 29 is a cutout 36*a*, so that when the tray slides by the stapler 25, the tray does not interfere with the stapler 25.

Figure 3:
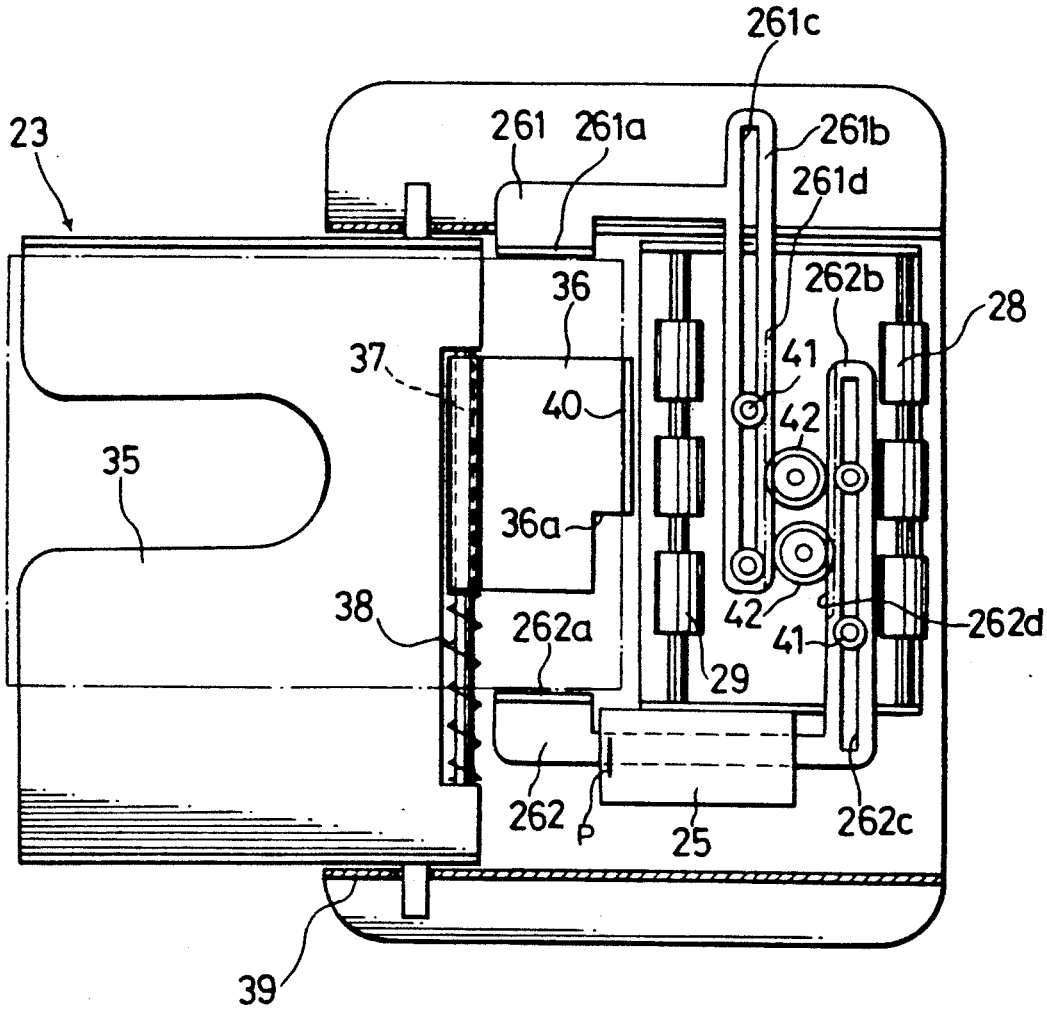
FIG. 3 is a section view taken along the line III—III of FIG. 2.

Lateral guides 261 and 262 are provided on either side of the slidable tray 36, forming a pair as shown in FIG. 3. The lateral guides 261 and 262 have contact surfaces 261*a* and 262*a* which abut the sides of the sheets stored in a bin 23, and guide portions 261*b* and 262*b* which guide the lateral guides 261 and 262 in their movement along the width direction of the sheets. The guide portions 261*b* and 262*b* are disposed to extend past each other perpendicular to the paper feeding direction. The guide portions 261*b* and 262*b* have guide slots 261*c* and 262*c* into which guide pins 41 fixed in the main frame 39 are inserted whereby the guide portions 261*b* and 262*b* are slidable on the guide pins 41. The guide portions 261*b* and 262*b* have racks 261*d* and 262*d* in opposed portions. Each of the respective racks 261*d* and 262*d* is engaged by a pinion 42 of a pair disposed between the guide portions 261*b* and 262*b*. Both pinions 42 are connected to corresponding motors 43 (indicated in FIG. 2) which are controlled independently of one another. Although only one of the motors 43 is shown in FIG. 2, two motors 43 are provided, corresponding to the two pinions 42.

Referring to FIGS. 2 and 3, the stapler 25 is located in a position over the lateral guide 262 such that it is neither an obstacle to the discharging of sheets, nor to the vertical movement of the bins 23.

As shown in FIG. 2, the bin driving system 24 includes sprockets 50 and 51 provided in the respective upper and lower portions of the main frame 39, a chain 52 extending around the sprockets 50 and 51, and a motor 53 for driving the sprocket 51. The battery consisting of the bins 23 together is vertically conveyed by the bin driving system 24.

As shown in FIG. 2, the partition frame 21 has an opening 45 located under the stapler 25 and above the stacker 27 for the discharge of stacks of sheets from the bins 23 into the stacker 27. A stack guide 46 for guiding stacks of sheets from the opening 45 into the stacker 27 is provided on the partition frame 21 under the opening 45. Provided at the opening 45 is a shutter mechanism 55 as shown in FIGS. 4A, 4B, 5A, and 5B. The shutter mechanism 55 includes a shutter 56 in the form of a comb which blocks the opening 45, a solenoid 57 for opening the shutter 56, and a spring 58 for forcing the shutter 56 to close. The shutter 56 is connected rotatably to a support 59 provided on the main frame 39. When the shutter 56 closes the opening 45 as shown in FIG. 4A, the stop 40 cannot rotate because the upper end of the paper stop 40 abuts the shutter 56.

Figure 6:
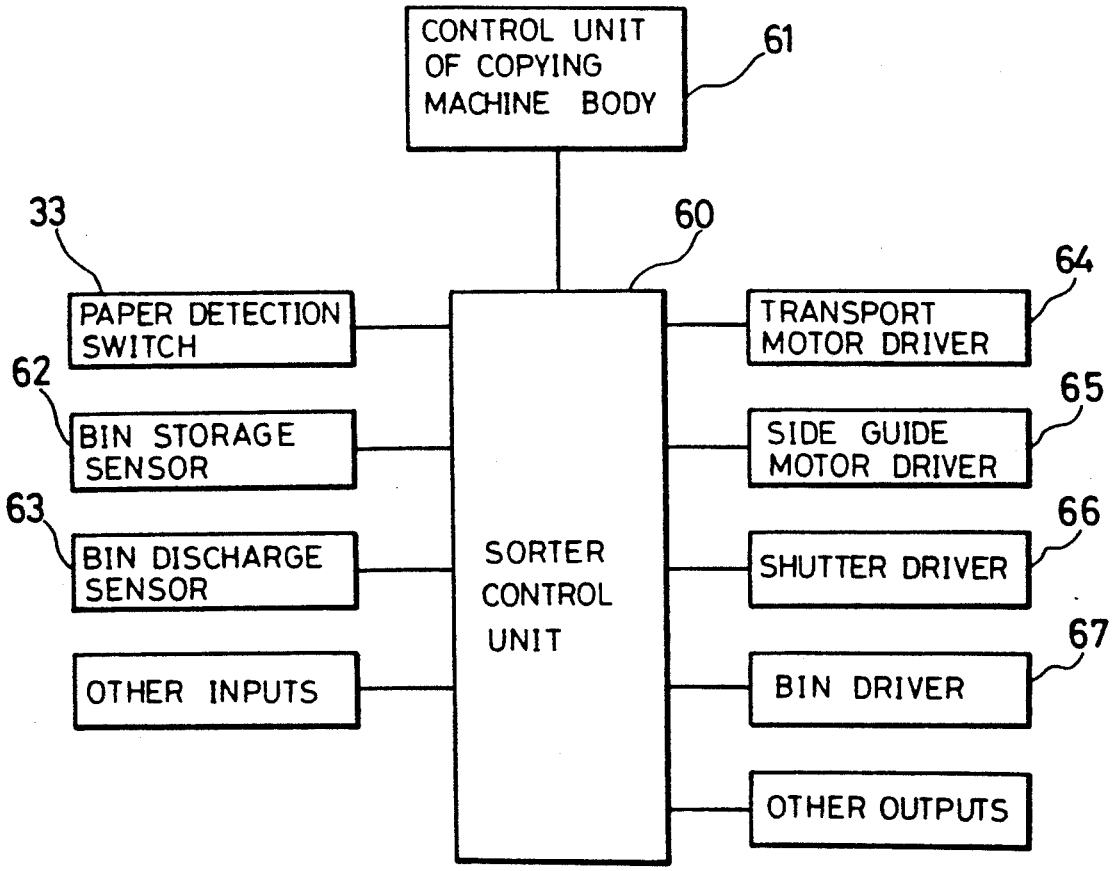
FIG. 6 is a block diagram showing a sorter controller.

The sorter 3 has a control unit 60, shown in FIG. 6. The control unit 60 is connected to a control unit 61 of the copying machine body 1, and has a microcomputer which includes a CPU, ROM, RAM, etc. The control unit 60 is connected with a paper detection switch 33, bin storage sensors 62 for detecting the storage of paper in the bins 23, a bin discharge sensor (photo sensor) 63 for detecting the discharge of stapled stacks of sheets from the bins 23 into the stacker 27, and miscellaneous inputs. The control unit 60 is further connected with a transport motor driver 64 for driving the transport motor 30, a motor driver 65 for driving the lateral guide motors 43, a shutter driver 66 for driving the solenoid 57 of the shutter mechanism 55, and a bin driver 67 for driving the bin drive motor 53.

Figure 7:
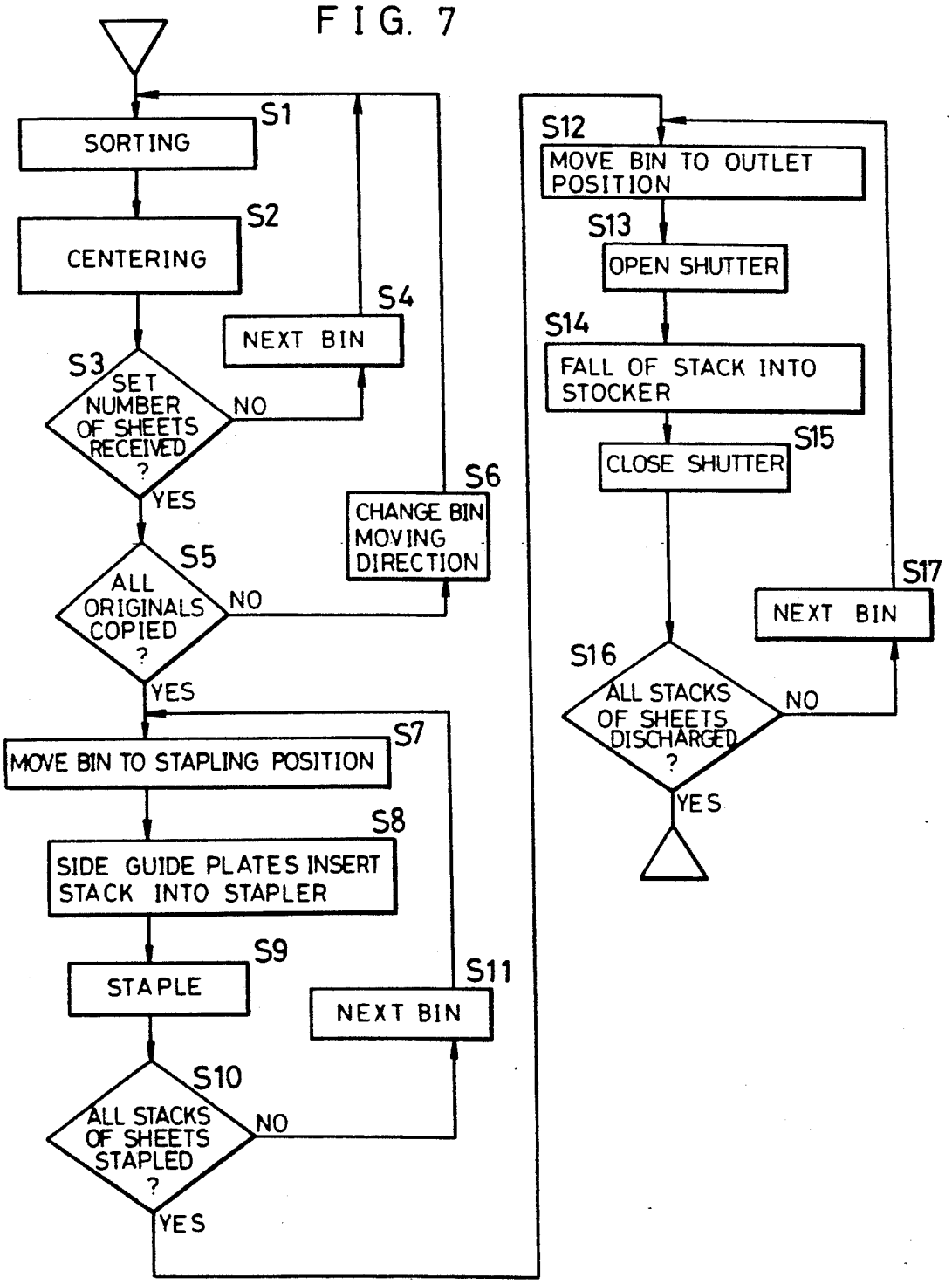
FIG. 7 is a flow chart describing sorter operation.

Operation of the sorter 3 will be described with reference to the flow chart of FIG. 7.

When the main switch of the body 1 of the copying machine is turned on, the components therein are initialized to prescribed conditions, and the sorter is also initialized, by moving the bins 23 to initial positions, for instance. If a staple mode is selected as a discharge mode by an operator through an operation panel on the copying machine body 1, the procedure shown in the flow chart of FIG. 7 is executed.

When sheets are successively discharged from the copying machine body 1, the sorting operation is carried out at step S1. First, the uppermost bin 23 is positioned at the level of the discharge rollers 29 so that the first sheet is discharged into the bin 23. When the sheet is received into the bin 23, at step S2 the lateral guide motors 43 drive the lateral guides 261 and 262 such that they approach each other until the distance between the guides 261 and 262 corresponds to the paper size which was transmitted from the control unit 61 of the copying machine body 1 to the control unit 60 of the sorter 3. Thus, the contact surfaces 261*a* and 262*a* of the lateral guides 261 and 262 abut both sides of the sheet, centering it in the width direction.

At step S3, it is determined whether the bins 23 have received a preset number of copies. If for example there are twenty bins 23 and the present number of copies is forty, the present number calculated for the determination is twenty and sorting and stapling processing is to be performed in two cycles (=40/20). At step S3, when the number of received sheets is smaller than the preset number, the program proceeds to step S4. At step S4, the bins 23 are raised by the bin driving system 24, so that the next bin 23 is positioned at the level of the discharge rollers 29. Then, the program returns to step S1, and steps S1 to S4 are executed repeatedly until the present number of sheets are stored in the bins 23 in a given order.

When the preset number of sheets have been received in the bins 23, the program proceeds from step S3 to step S5. At step S5, it is determined based on a signal from the control unit 61 of the copying machine body 1 whether all originals have been copied. If all originals have not been copied, the program proceeds to step S6 to provide a signal for reversing the conveyance direction of the bins 23. Subsequently, the program returns to step S1. Steps S1 to S6 are then executed repeatedly until all originals have been copied.

When the preset number of sheets for all originals have been received in the bins 23, the program proceeds from step S5 to step S7. At step S7, the lowermost or uppermost bin 23 is moved into the position where the stapler 25 operates. Whether the battery of bins 23 is located above or under the stapler 25 at the end of the sorting operation depends upon whether the number of originals is an odd number or an even number.

At step S8, a stack of sheets is inserted into the stapler 25 at a stapling position P by the lateral guides 261 and 262. This procedure is shown in FIGS. 8A to 8C.

Figure 8A:
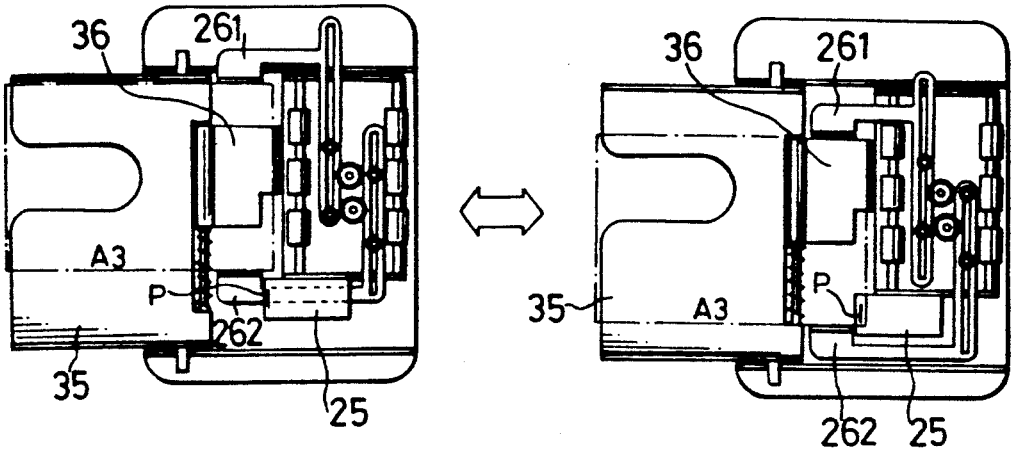
FIGS. 8A, 8B and 8C are plan views for showing lateral guides in operation.
Figure 8B:
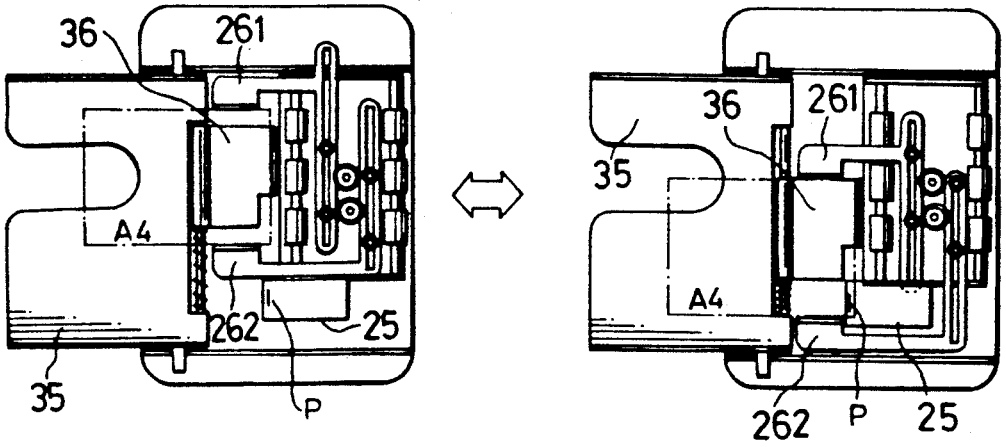
Figure 8C:
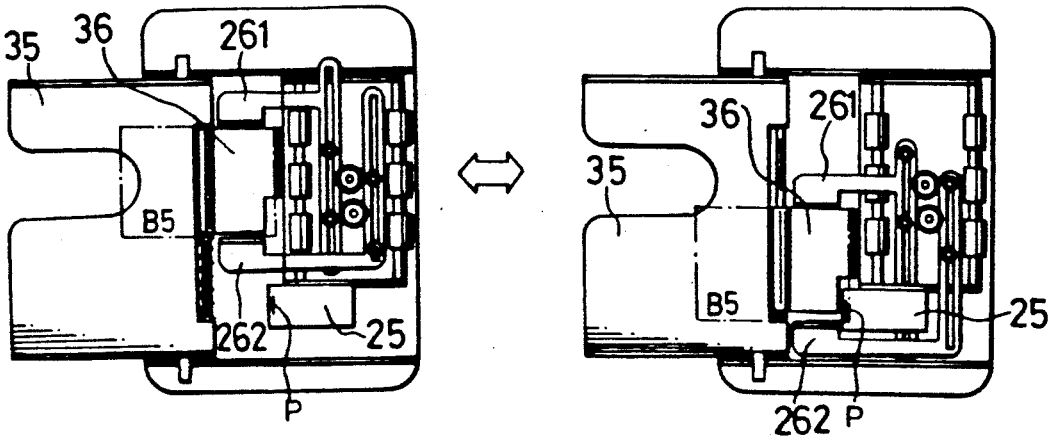

For example, if the paper is A3 size as shown in FIG. 8A, the lateral guide motors 43 drive the lateral guides 261 and 262 bring them into abutment on both sides of A3-size sheets. Then, the guides 261 and 262 retaining the stack of sheets move so that the corner of the stack closest to the stapler 25 is inserted into the stapler 25 at the position P. If the paper is A4 size or B5 size, as shown in FIGS. 8B and 8C respectively, the distance by which the lateral guides 261 and 262 move is controlled to correspond to the paper size, A4 or B5, whereby the corner of the stack closest to the stapler 25 is moved into the stapling position P of the stapler 25. When the lateral guides 261 and 262 are moved by a large amount as shown in FIGS. 8B and 8C, the contact surface 261*a* of the lateral guide 261 abuts the rear end of the slidable tray 36 to move the slidable tray 36 in opposition to the spring 38. Thus, the slidable tray 36 is moved together with the stack of sheets, as the tray retains the trailing end of the stack.

When the corner of the stack is located into the stapling position P of the stapler 25 at step S8, the program proceeds to step S9. At step S9, the stapler 25 operates to staple the stack of sheets in the bin 23. At step S10, it is determined whether all the stacks of sheets stored in the bins 23 have been stapled. If all of the stacks of sheets in the bins 23 have not been stapled, the program proceeds to step S11. At step S11, the next bin 23 is conveyed by the bin driving system 24 to the position wherein the stapler 25 is located, and steps S7 to S9 are executed again.

The operations at steps S7 to S11 are thus repeated until all of the stacks in the bins have been stapled, and then the program proceeds from step S10 to S12.

Figure 5A:
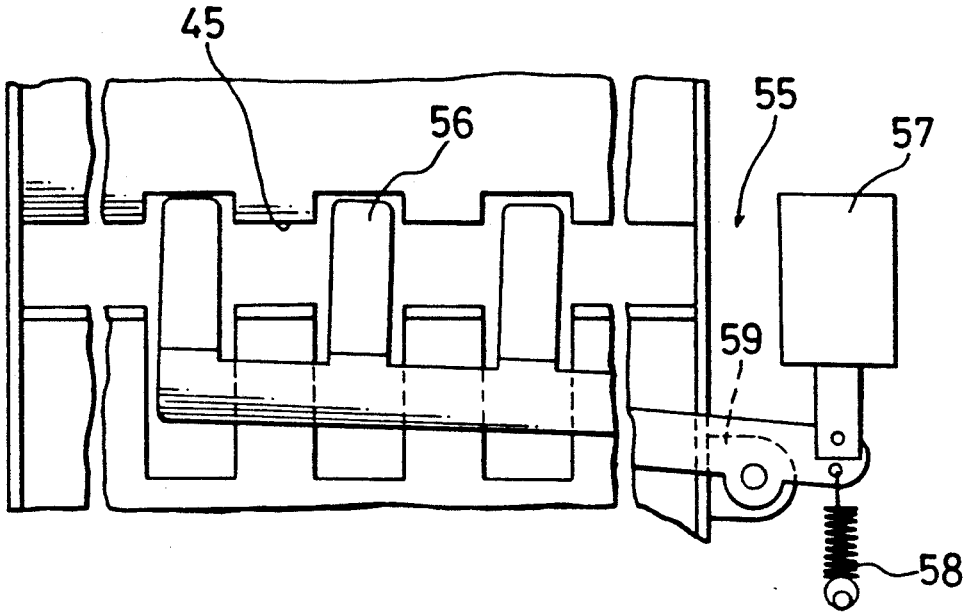
FIGS. 5A and 5B are partial section views showing the shutter mechanism in operation.
Figure 5B:
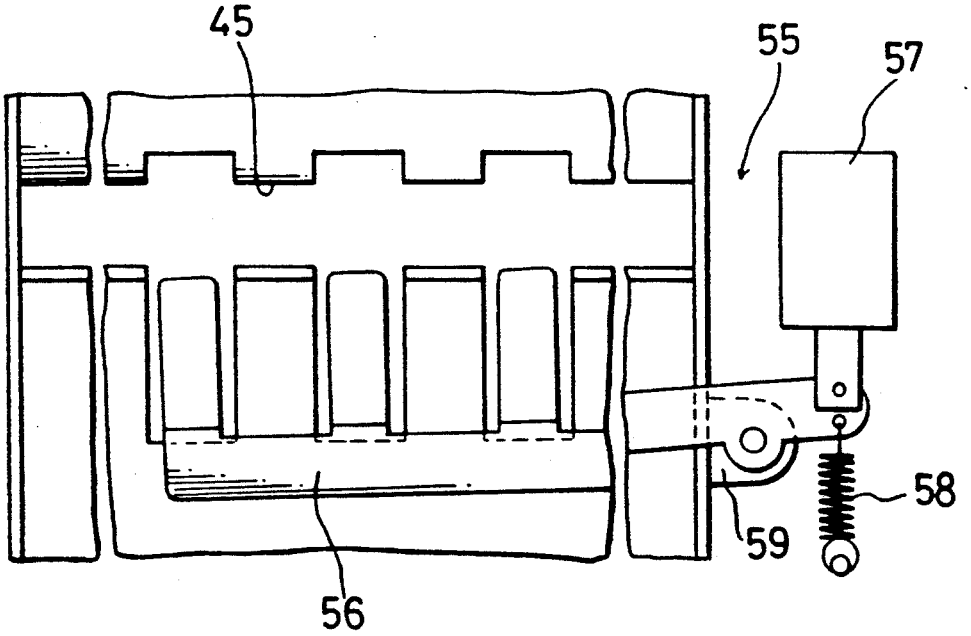

At step S12, the lowermost or uppermost bin 23 is conveyed before the opening 45. At step S13, the solenoid 57 is activated to move the shutter 56 downward, whereby the opening 45 is unblocked. This unblocked state is shown in FIGS. 4B and 5B. Therefore the paper stop 40 automatically rotates by 90°, clockwise in FIG. 4A, to be in the same plane as the paper placing surface of the slide tray 36, since when the shutter 56 is located in the opening 45 the paper stop 40 is impelled against the partition frame 21 by the spring as described previously. Consequently, the paper stop 40 is released, and the stack of sheets stored in the bin 23 falls through its own weight along the stack guide 46 into the stocker 27.

Provided in the vicinity of the opening 45 is a bin discharge sensor 63 (not shown in FIGS. 4A and 4B) for detecting a stack of sheets passing through the opening 45 and falling into the stocker 27. When it is determined a step S14 that the stack of sheets has fallen into the stacker 27, the program proceeds to step S15. At step S15, the solenoid 57 is deactivated. As a result, the shutter 56 is moved upward by the spring 58, closing the opening 45.

At step S16, it is determined whether all of the stapled stacks of sheets have been discharged from the bins 23. If all of them have not been discharged, the program proceeds to step S17 in order to convey the next bin 23 into the position before the opening 45, and the program returns to step S12. The operations at steps S12 to S17 are then repeated until all of the stapled stacks have been discharged from the bins 23. Discharging all of the bins 23 completes one sorting, stapling and discharging cycle.

If there are twenty bins 23 and the preset number of copies is forty as described above, the procedure shown in FIG. 7 is executed in two cycles, corresponding to the first and second calculated numbers of sheets.

In the above-described embodiment, sorting and stapling of a given number of sheets greater more than the number of bins 23 can be performed in a short time without need of handling by the operator.

Since a stack is moved into the stapling position by means of the lateral guides 261 and 262, no other particular means is required for moving paper into the stapling position, and thus the structure of the sorter is simplified. In addition, since the stacks are moved into the stapling position, the stapler 25 can be provided in a location such that it is not an obstacle to the discharging operation nor to the bin conveying operation, and the stapler 25 does not require any driving mechanism.

The means of moving the stacked sheets into the stapling position by the lateral guides 261 and 262 retaining the sheets on either side is such that it prevents the sheets from becoming disarranged or irregularly raised while they are moved.

In addition, since the stacks of sheets automatically fall through their own weight from the bins 23 into the stacker 27, the mechanism for discharging the sheets from the bins 23 is made simple.

In addition, since the stacker 27 is provided in a portion under the transport path 22 which has been "dead" space in the conventional apparatus, it is possible to effectively utilize the space whereby a compact sorter is provided.

Second Embodiment

Figure 9:
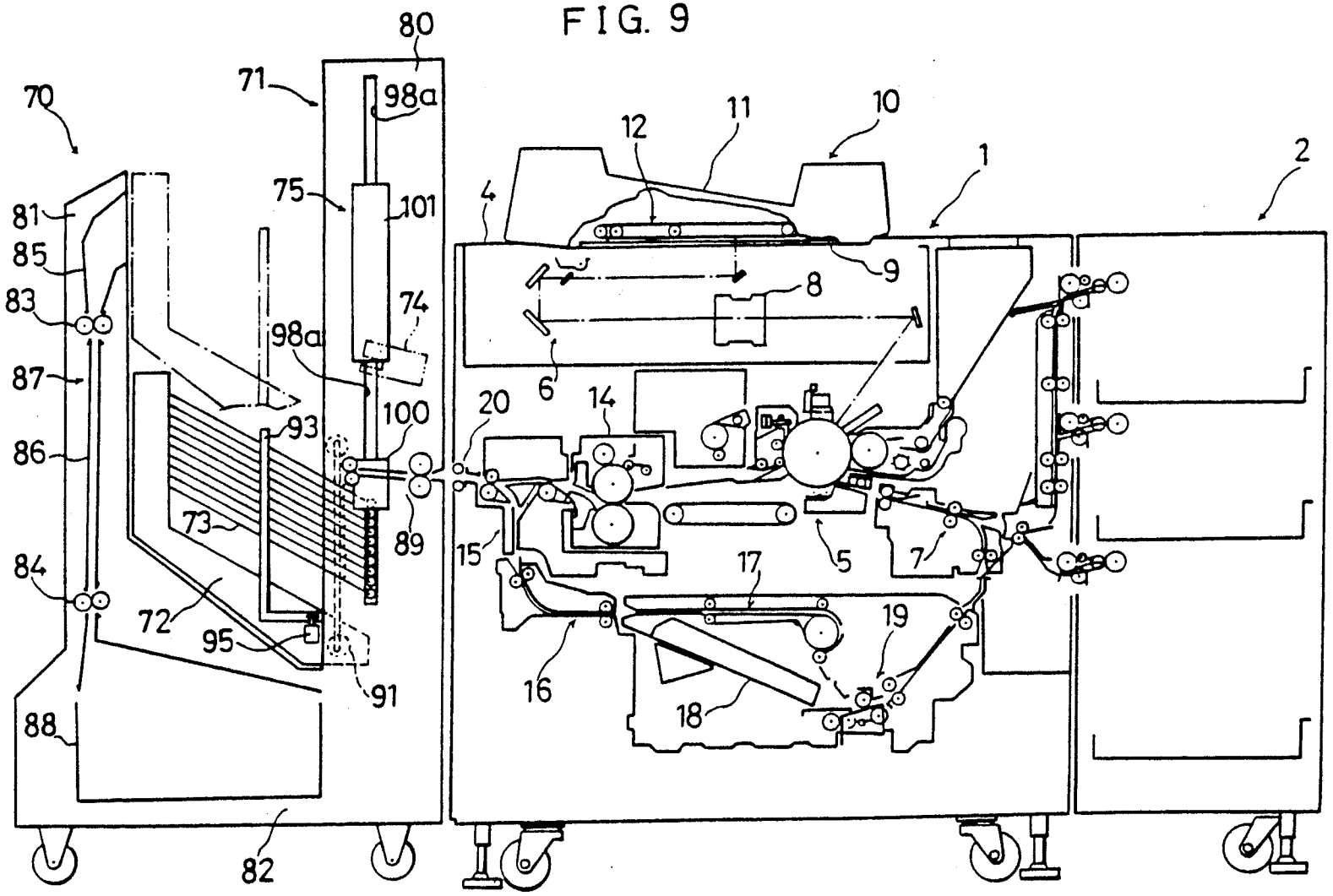
FIG. 9 is a schematic section view showing a copying machine equipped with a sorter incorporating stapler according to the second embodiment of the present invention.

FIG. 9 shows a copying machine equipped with a sorter having a stapler according to the second embodiment of the present invention. The copying machine body 1 is of the same construction as that of the first embodiment.

A sorter 70 includes chiefly a main frame 71, a bin retainer 72, a plurality of bins 73 for receiving sheets in a given order, a stapler 74 for stapling the stacks of sheets in the bins 73, and a bin conveying mechanism 75 for vertically conveying the ends of the bins 73 upon which the trailing edges of the fed sheets are placed. The stapler 74 is movable in the paper width direction in order to correspond to the paper's size.

The main frame 71 has a right side portion 80, a left side portion 81, and a bottom portion 82, forming an approximate "U". The left side portion 81 has transport rollers 83 and 84 for transporting stacks of sheets, and a stack transport path 87 consisting of guide plates 85 and 86 for guiding the transported paper. The bottom portion 82 has a stocker 88 for storing stacks of sheets supplied through the stack transport path 87. In the right side portion 80, a transport path 89 for transporting sheets discharged from the discharge rollers 20 into the bins 73 is provided at a position corresponding to the discharge rollers 20.

Figure 10:
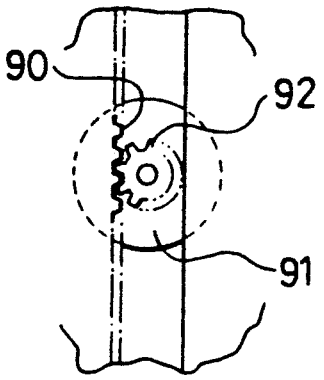
FIG. 10 is a front partial view showing the driving mechanism to the bin retainer in the sorter.

The bin retainer 72 retains first ends, or sheet-receiving ends, and second ends, or sheet-discharging ends, of the bins 73 and it is movable vertically in the space between the right side portion 80 and left side portion 81. A driving mechanism for vertically moving the bin retainer 72 includes, as shown in FIG. 10, a rack 90 formed vertically in the right side portion 80, a motor 91 fixed to a base portion of the bin retainer 72, and a pinion 92 fixed to a shaft of the motor 91 and engaging with the rack 90. The driving mechanism as described above is provided on either of the two sides (rear and front with respect to an operator) of the bin retainer 72.

Figure 11:
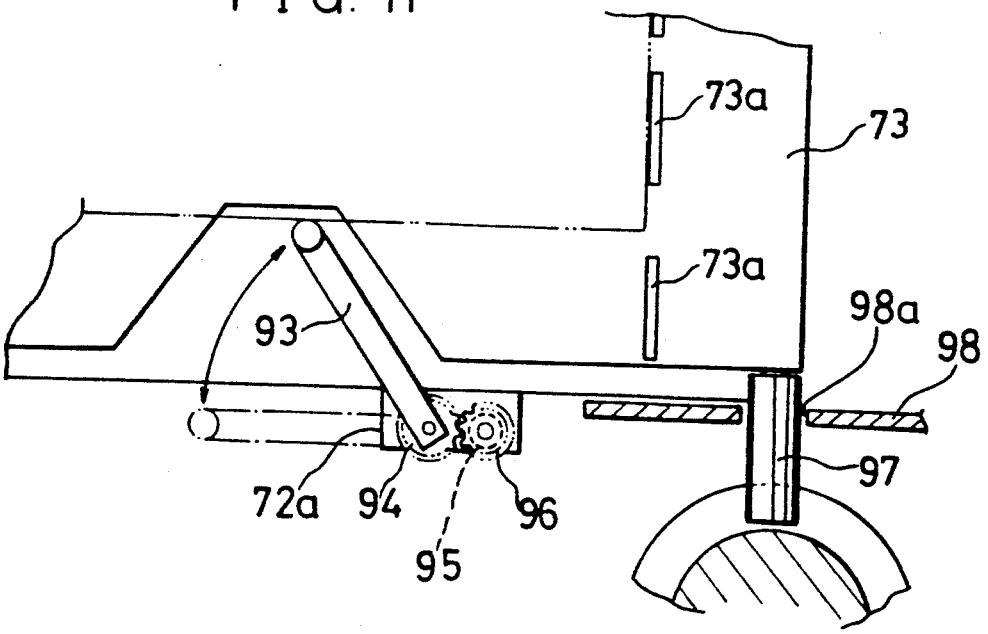
FIG. 11 is a partial plan view showing a bin and a cam.

The bin retainer 72 is provided with lateral guides 93 for adjusting the stacks of sheets stored in each bin 73 in the sheet width direction as shown in FIG. 9 and in FIG. 11. A pair of lateral guides 93 are opposingly provided in the front and rear sides of the sorter. Both lateral guides 93 include an L-shaped bar, of which the base portion is rotatably supported by a projecting portion 72*a* of the bin retainer 72, and a gear 94 fixed to their base portions. A motor 95 is fixed onto the projecting portion 72*a* on either side of the bin retainer 72, and a gear 96 fixed to the motor 95 is engaged with the gear 94. The lateral guides 93 are rotated by the motors 95 so as to abut either side of the sheets in the width direction, whereby the sheets are arranged in proper stacks.

The forward end of each bin 73, whereon the leading edge of a sheet is located, is supported by the bin retainer 72, and the back end of each bin 73, whereon the trailing edge of a sheet is located, is inserted into the right side portion 80. The bins 73 slope such that their forward ends are located higher than their back ends. As shown in FIG. 11, a paper stop 73*a* for checking the trailing edges of stored sheets is provided in the back end of each bin 73. A trunnion 97 is provided on each of two sides of the back ends of the bins widthwise. The trunnions 97 are guided in vertically extended guide grooves 98*a* in a frame 98 of the right side portion 80 whereby they move vertically. Adjacent trunnions 97 to the respective vertically disposed bins 73 are in contact with each other.

The bin conveying mechanism 75 is provided inside the right side portion 80 of the main frame 71. The bin conveying mechanism 75 includes, on either side of the back end portion of the bins 73, a first screw-cam mechanism 100 for increasing the spacing between adjacent bins 73, and a second screw-cam mechanism 101 for changing the position of the bins 73 from the state inclined as shown in FIG. 9 to an oppositely-inclined state. These first and second screw-cam mechanisms 100 and 101 are driven by a motor and a gear mechanism not shown. The first and second screw-cam mechanisms 100 and 101 are spaced in such a way as to allow all of the bins 73 to be located therebetween. In order to staple the stacks of sheets after they have been stored into all of the bins 73 in a given order, a stapler 74 is provided at the lower end of one of the second screw-cam mechanisms 101.

Figure 12:
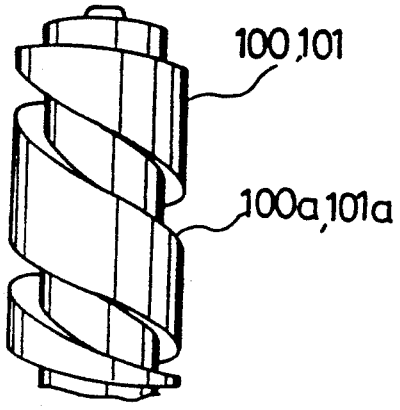
FIG. 12 is a partial front view showing a screw cam for vertically moving bins.

The first and second screw-cam mechanisms 100 and 101 is consist of a cylinder having a spiral groove (100*a* and 101*a* respectively), as shown in FIG. 12. The trunnions 97 of the bins 73 engage into the grooves 100*a* and 101*a* such that the back ends of the bins 73 may be moved vertically.

The operation of this embodiment will now be described.

When the staple mode is selected in the copying machine body 1, the bins 73 are moved vertically, whereby the sheets are sorted to form stacks, and then the stacks of sheets are stapled by the stapler 74. In this description, the preset number of of bins 73.

In the initial condition, all the bins 73 are located under the first screw-cam mechanism 100 as shown in FIG. 9. Then, sheets are successively discharged by the discharge rollers 20, so as to be stored in the bins 73 through the transporting path 89. When a sheet is received in the uppermost bin 73, the bin retainer 72 is then moved upward to engage the trunnions 97 of the uppermost bin 73 with the grooves 100*a* of the first screw-cam mechanism 100. Then, the first screw-cam mechanism 100 is rotated by the driving system not shown, whereby the back end of the uppermost bin 73 is conveyed toward the upper end of the first screw-cam mechanism 100. Consequently, a space corresponding to the height of the first screw-cam mechanism 100 is formed between the uppermost bin 73 and the following bin 73 such that the succeeding sheet discharged from the copying machine body 1 is easily received into the next bin 73.

The same operation is repeated until the preset number of copies is made or a sheet is stored into the lowermost bin 73. Then, the first original is replaced by the second original. In the copy process of the second original, the first-copied sheet is stored into the last bin 73 at which the first copy process was terminated. Then, while the bin retainer 72 is lowered by one bin, the first screw-cam mechanism 100 is driven in the direction opposite to that described above, whereby the bins 73 are successively lowered as the sheets are stored in the given order. Thus, the sheets are successively stored into the respective bins 73 while the bins 73 are conveyed upward or downward by the first screw-cam mechanism 100.

After the sheets are received and stored into each bin 73, the pair of lateral guides 93 rotate from the position indicated by the partially dotted lines into the position indicated by the solid lines in FIG. 11, so as to form properly stacked sheets.

When the sheets corresponding to all of the originals are stored into the bins 73, the bins 73 will be located either under or above the first screw-cam mechanism 100, depending on whether the number of originals is odd or even.

Figure 13A:
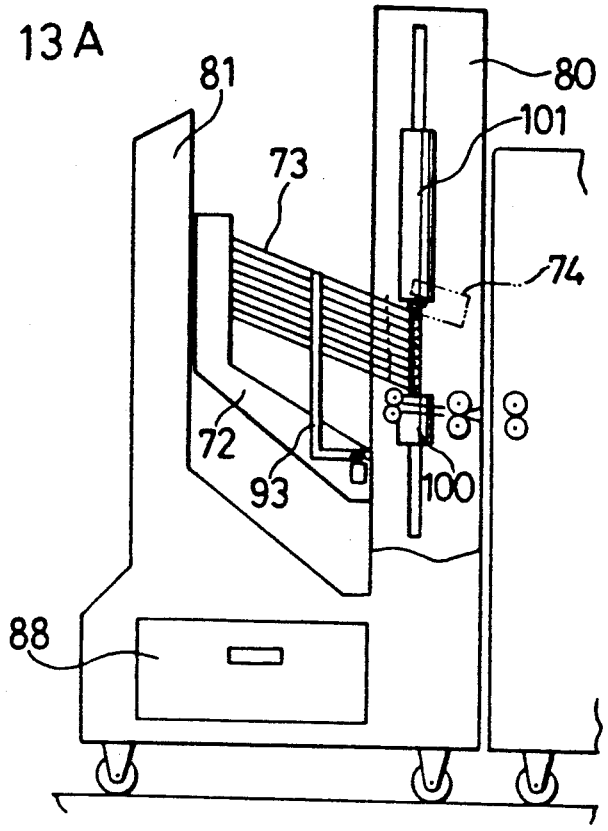
FIGS. 13A and 13B are section partial views showing the sorter in operation.

The bins 73, starting from the uppermost, are then raised successively into the stapling position, wherein each stack of sheets in the bins 73 is stapled by the stapler 74. The stapler 74 is capable of taking both a stapling position, as shown in FIG. 9, and a drawn position in which it does not interfere with the vertical movements of the bins 73. In a stapling operation, the stapler 74 is moved along the paper's width to correspond to the paper size. FIG. 13A shows the stapler 74 having begun to staple.

Figure 13B:
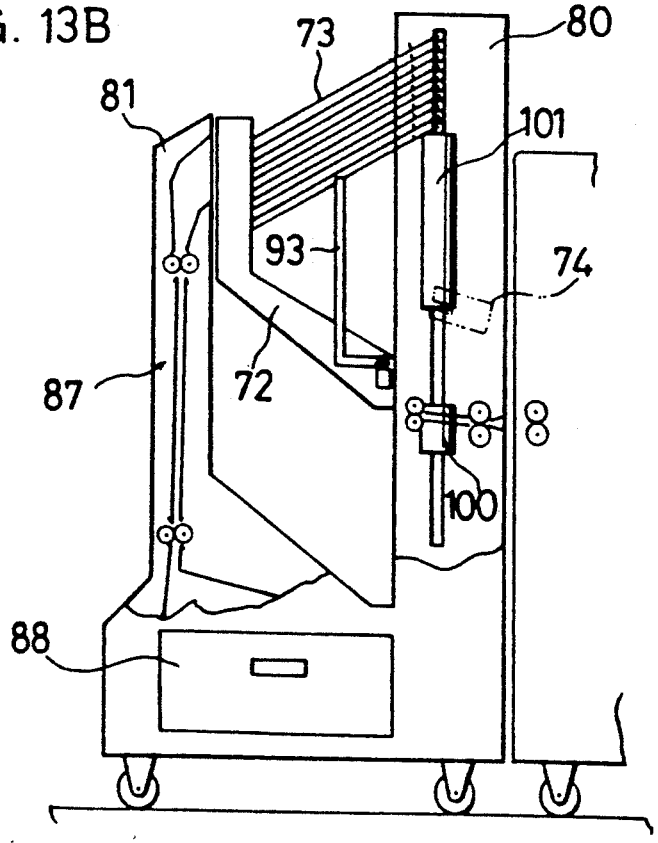

After each stack of sheets in the bins 73 is stapled, the bin retainer 72 is moved upward, whereby the trunnions 97 of the bin 73 engage with the grooves 101*a* of the second screw-cam mechanism 101. The second screw-cam mechanism 101 is driven by the driving system not shown, and the trunnions 97 move upward along the grooves 101*a* of the second screw-cam mechanism 101. As a result of the upward movement of the trunnions 97, the bins 73 slope such that their back ends become located higher than their forward ends, as shown in FIG. 13B. Thus, the stapled stack of sheets stored in each bin 73 drops into and through the stack transporting path 87 in the left side portion 81 and is stored into the stocker 88.

After all of the stapled stacks of sheets in the bins 73 are stored into the stocker 88, the bin retainer 72 is lowered and the cam mechanisms 101 and 100 are driven in the direction opposite to that described above, whereby all the bins 73 are returned to the initial state shown in FIG. 9. Subsequently, the operation as described above may be repeated cyclically until the preset number of copies are furnished.

In the sorting operation according to this embodiment, the bins 73 initially are sloped with the back ends being located lower than the forward ends. Accordingly, the trailing edge of a sheet having passed through the paper discharging portion will abut on the paper stop 73*a* located under the discharging portion, thereby permitting various sizes of sheets to be sorted and stapled with minimal possibility of error.

After the stacks of sheets are stapled, the bins 73 have their back ends raised higher than their forward ends, whereby the stapled stack of sheets in each bin is discharged into the stack transporting path 87 through its own weight. Thus, no special device for drawing the stacks out of the bins 73 is necessary, and the structure of the sorter is simplified.

Another means for changing the position of the bins 73, another structure employing cylinders for example, may be used in lieu of the screw-cam mechanism 101.

The sheets may be arranged in the bins 73 with respect to one side of the sheets, instead of to the center line of the sheets. In this case, a lateral guide may be provided in the rear side of the sorter and a paper regulator plate may be provided on the front side of each bin. In order to facilitate maintenance, the stapler is disposed in the front side of the sorter. Movement of the stapler along the paper's width direction is not necessary, since in this case the sheets are properly stacked by the lateral guide and the paper regulator plate on the front side portion of each of the bins 73.

Third Embodiment

Figure 14:
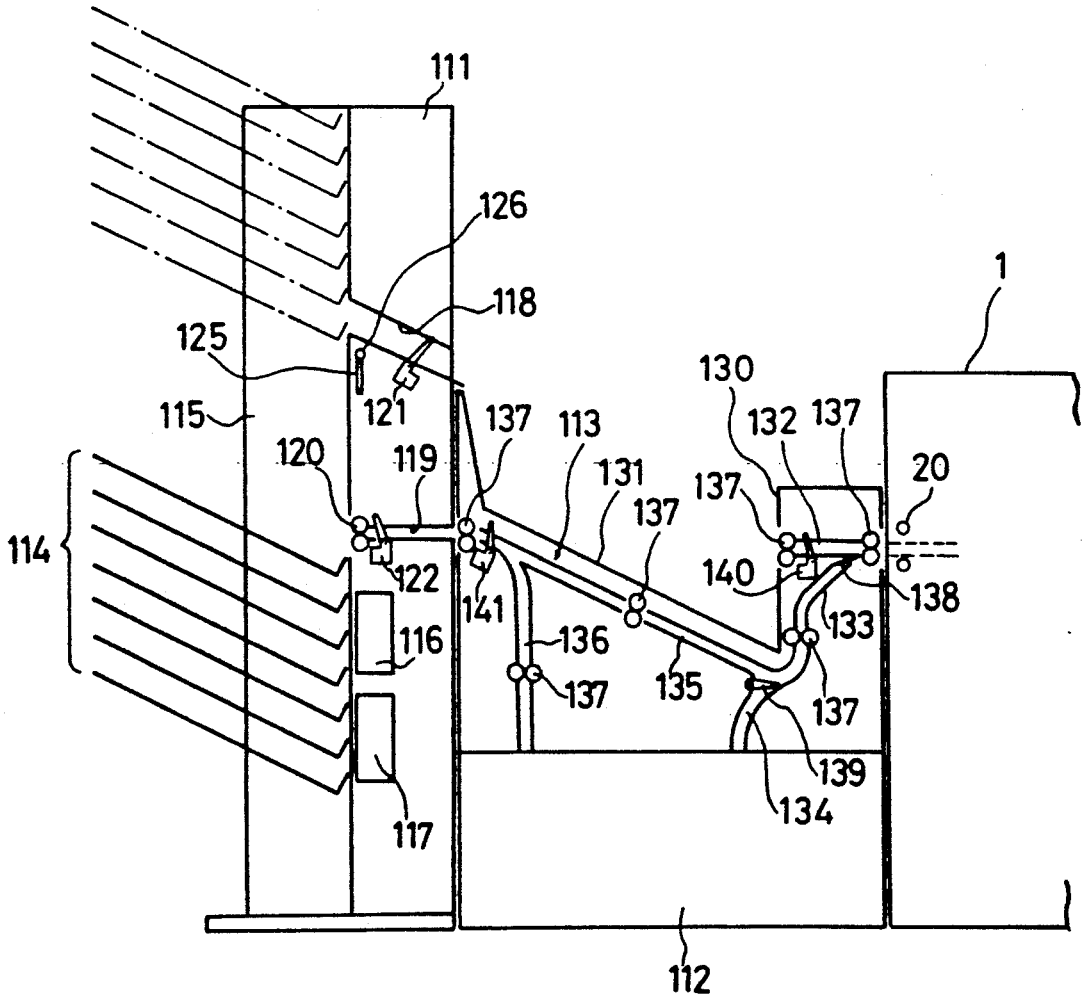
FIG. 14 is a schematic sectional view showing a sorter incorporating a stapler according to the third embodiment of the present invention.

FIG. 14 shows a copying machine equipped with a sorter incorporating a stapler according to the third embodiment of the present invention.

This copying machine includes a main body 1, a sorter 111 incorporating a stapler, a paper folding unit 112 disposed between the body 1 and the sorter 111, and a transport path 113 disposed over the paper folding unit 112. The copying machine body 1 is of the same structure as that of the above-described embodiments.

The sorter 111 has a plurality of bins 114 for temporarily storing sorted sheets. These bins 114 slope with their forward or left, ends, being located higher than the back or right, ends. The bins 114 are moved by an elevating unit 115 between a home position, indicated by solid lines in FIG. 14, and an uppermost position, indicated by partially dotted lines. There is provided, alongside the lower end of the bins 114, a stapler 116 for stapling sheets sorted into the bins 114. A punching unit 117 for punching the sheets is provided below the stapler 116. The sorter 111 has an outlet 118 in a position corresponding to the lowermost one of the bins 114 when located in their uppermost position. The outlet 118 has the same slope as that of the bins 114 so as to be continuous with the paper retaining surface of the corresponding bin 114. The sorter 111 further has a feed opening 119 above the back end of the uppermost of the bins 114 located in the home position. Discharge rollers 120 for transporting paper are provided at the exit of the feed opening 119. Sheet-detection switches 121 and 122 are provided in the outlet 118 and the feed opening 119, respectively.

Figure 15:
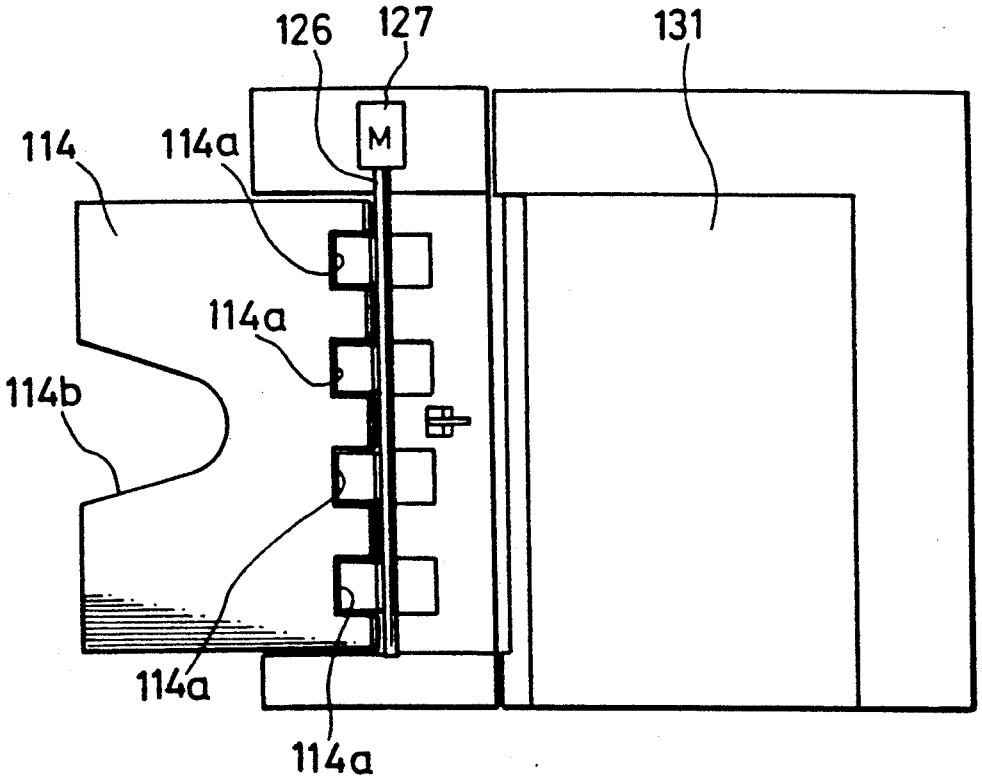
FIG. 15 is a partial plan view showing the sorter.
Figure 16A:
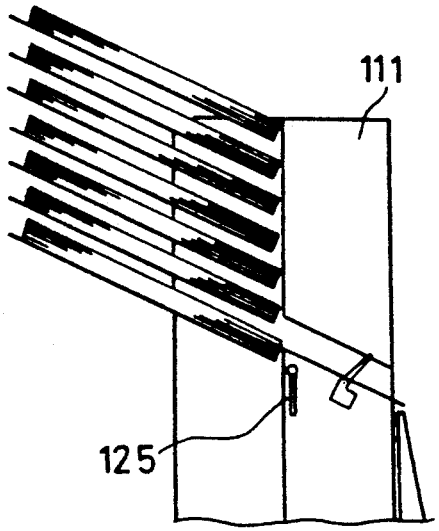
FIGS. 16A to 16E are partial section views showing the sorter in operation.
Figure 16B:
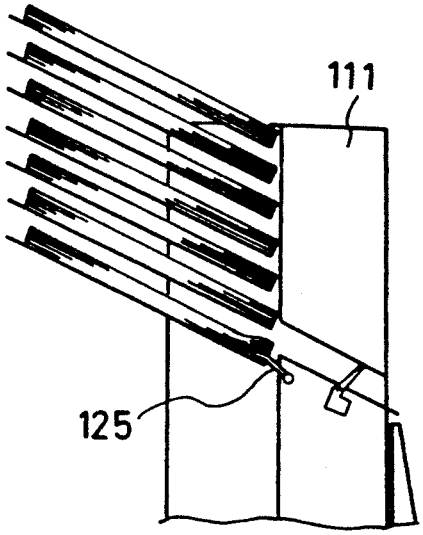
Figure 16C:
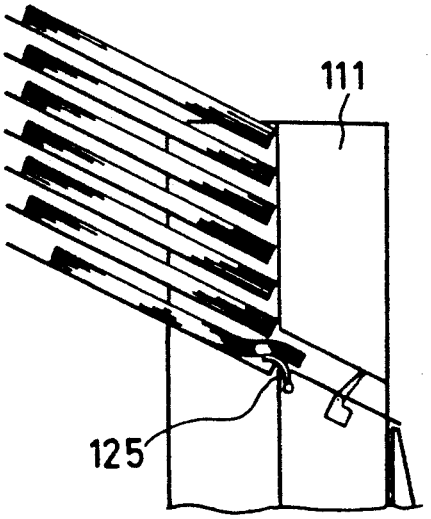
Figure 16D:
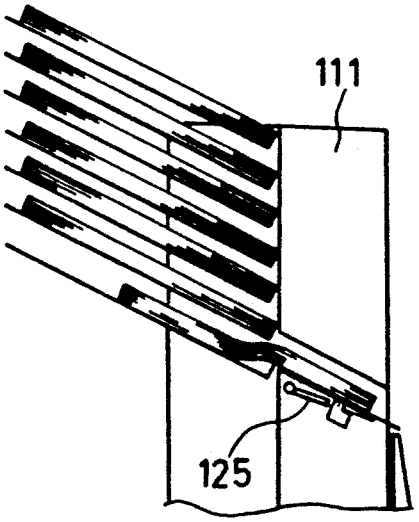
Figure 16E:
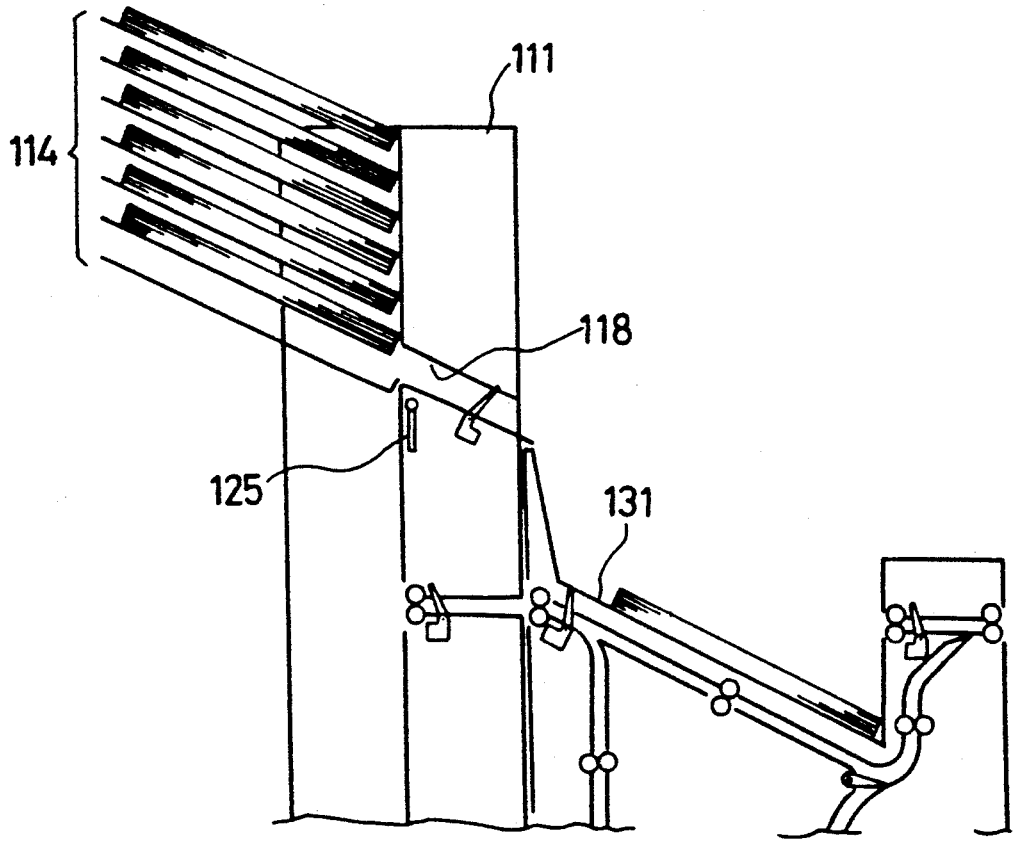

A scraper 125 for scraping out the stack of sheets from the bin 114 into the outlet 118 is provided in an end portion of the outlet 118 along the bins 114. The scraper 125 is formed of a flexible plate such as a rubber plate and fixed to a shaft 126, as shown in FIG. 15. The shaft 126 is rotatably driven by a motor 127. Each bin 114 has cuts 114*a* enabling the scraper 125 to pass therethrough. A cutout 114*b* is formed at the forward end, or free end, of each bin 114 so that the operator can easily remove the paper.

The transporting path 113 is within a housing 130. The upper portion of the housing 130 constitutes a stacker 131 for storing paper. The stacker 131 has essentially the same slope as that of the bins 114 and the outlet 118. Stacks of sheets discharged through the outlet 118 are stored into the stacker 131.

Inside the housing 130, there are provided a first transport path 132 for directly discharging sheets from the discharge rollers 20 into the stacker 131, a second transport path 133 for transporting sheets from the discharge rollers 20 toward the paper folding unit 112 or toward the sorter 111, a third transport path 134 for transporting sheets from the second transport path 133 to the paper folding unit 112, a fourth transport path 135 for transporting sheets from the second transport path 133 to the sorter 111, and a fifth transport path 136 for transporting sheets from the paper folding unit 112 to the sorter 111. Each of the transport paths is provided with transport rollers 137, and branching portions of the transport paths are provided with levers 138 and 139 capable of changing the directions of sheet transport. Switches 140 and 141 for detecting transported sheets are provided at exits of the first and fourth transport paths 132 and 135, respectively.

Operation of the foregoing will now be described.

Copy-processed sheet in the copying machine body 1 are successively transported through the transporting path 113, and the bins 114 of the sorter 111 are conveyed from the home position shown in FIG. 14 upward and back downward repeatedly, whereby the sheets are sorted and stored into the respective bins 114. After a sorting operation is complete, the stacks of sheets in the bins 114 are stapled by the stapler 116. The stapled stacks of sheets are subsequently punched as required by the punching unit 117.

The bins 114 then move upward into the position indicated by the partially dotted lines in FIG. 14, whereupon the motor 127 is activated to start rotating the scraper 125. As the scraper 125 rotates, the trailing end of the stack in the bin 114 located opposite the outlet 118 is lifted by the scraper 125, and the stack of sheets is introduced into the outlet 118, as shown in FIGS. 16A to 16E. Since the bins 114 have their forward ends located higher than their back ends, the stacks of sheets are discharged into the stacker 131 through their own weight. The bins 114 are successively lowered while the discharging operation is repeated, whereby all the stapled stacks of sheets in the bins 114 are stored in the stacker 131.

When the bins 114 are moved downward and returned to the home position indicated in FIG. 14, the aforedescribed procedure may be repeated. Thus, even if the number of copies preset in the copying machine body 1 is larger than the number of bins 114, the full sorting operation can be performed without any inconvenience. In an instance in which copy-processed sheets in the copying machine body 1 are folded by the folding unit 112, the sheets are transported from the body 1 through the folding unit 112 to the sorter 111, whereby the folded sheets are sorted in the same manner.

Figure 17A:
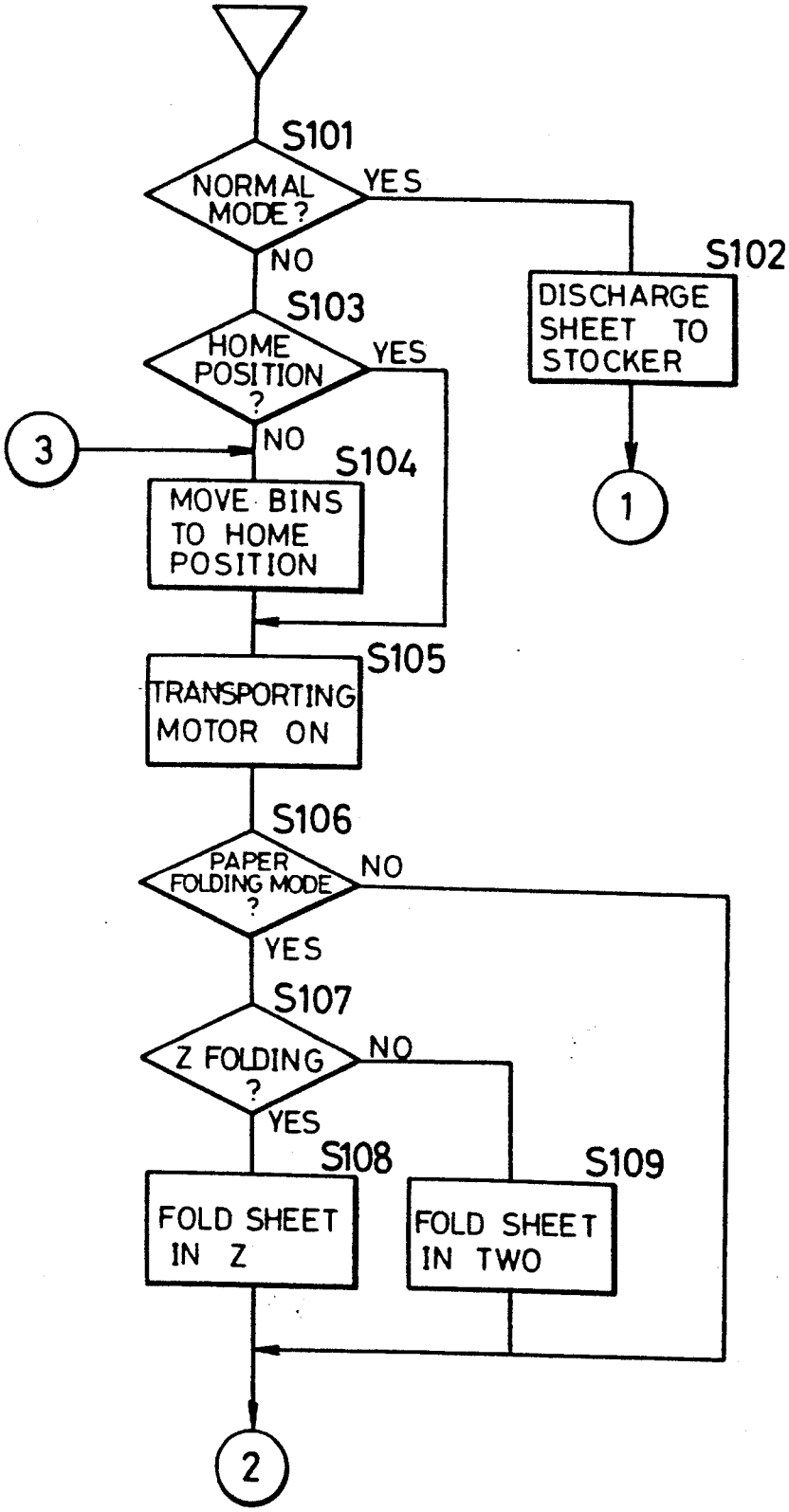
FIGS. 17A and 17B are flow charts describing the operation of the sorter.
Figure 17B:
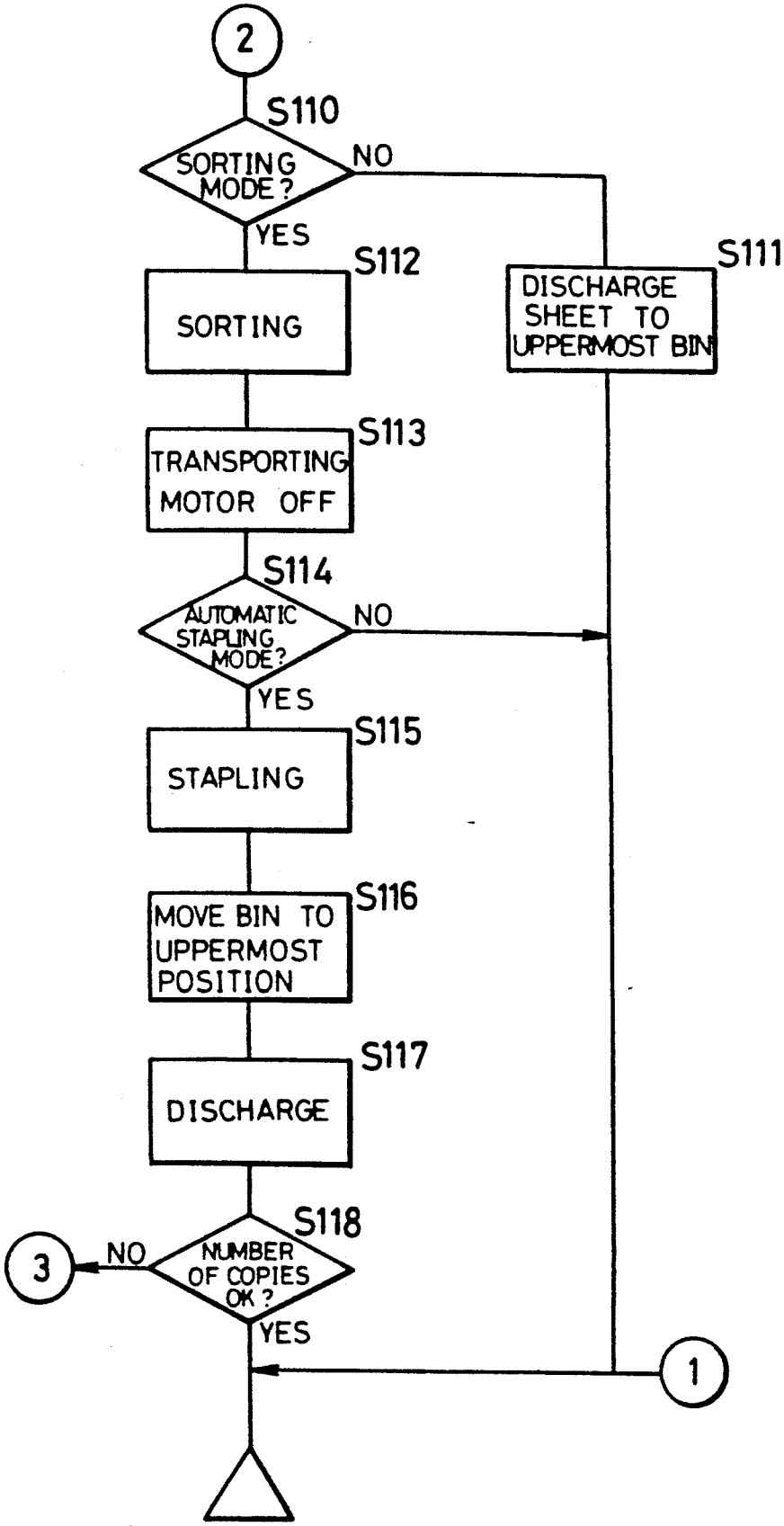

The control operation of this embodiment will hereinafter be described with reference to the flow charts in FIGS. 17A and 17B.

First, at step S101, it is determined whether the copy mode is normal. If it is the normal mode, the program proceeds to step S102. At step S102, the position of the lever 138 is shifted so as to discharge sheets from the copying machine body 1 through the first transporting path 132 directly into the stocker 131.

If a sorting mode, a stapling mode or a punching mode is selected, it is determined at step S101 that it is not the normal mode (NO) and the program proceeds to step S103. At step S103, it is determined whether the bins 114 are returned into their home position. This determination is made in dependency upon a switch (not shown) which is activated when the bins 114 are in their home position. If the bins 114 are not in their home position, the program proceeds to step S104, where the elevating unit 115 is driven to return the bins 114 to their home position, and then the program proceeds to step S105. If it is determined at step S103 that the bins 114 are in their home position, the program skips step S104 and proceeds to step S105. At step S105, a paper transport motor (not shown) is driven.

At step S106, it is determined whether the paper folding mode has been selected. If the paper folding mode has been selected, the program proceeds to step S107 to determine whether Z-folding mode (wherein fold a sheet is folded in three, hence in the form of the letter Z) is selected as the paper folding mode. If the Z-folding mode is selected, the program proceeds to step S108 to produce a "Z" fold in the sheet. If folio mode (wherein a sheet is folded in two) is selected, NO is determined at step S107 and the program proceeds to step S109 to fold the sheet in two. If the paper folding mode is not selected, the program proceeds from step S106 to step S110 of FIG. 17B.

At step S110,it is determined whether the sorting mode has been selected or not. If the sorting mode has been selected, the program proceeds to step S112 to sort the sheets. In this process, the bins 114 are successively raised, whereby the sheets are received into the respective bins 114. When the sorting process is complete, the transporting motor is temporarily halted at step S113. If the sorting mode has not been selected, NO is determined at step S110, and the program proceeds to step S111 to deliver sheets into the uppermost bin 114 through the feed opening 119.

At step S114, it is determined whether an automatic stapling mode for automatically stapling the sheets stored in the bins 114 has been selected. If the automatic stapling mode has been selected, the program proceeds to step S115 for the stapling process in which the sheets stored in the bins 114 are stapled by the stapler 116. Then, at step S116, the bins 114 are raised to the position shown by the partially dotted lines in FIG. 14. At step S117, the stapled stacks of sheets are successively discharged from the bins 114 into the stacker 131 by the scraper 125. At step S118, it is determined whether the aforementioned process is complete for the preset number of copies. If the process is not complete, the program returns to step S104 in order to repeat the operation as aforedescribed.

If the automatic stapling mode is not selected at step S114, the bins 114 are not moved into the uppermost position, in order to prevent unstapled sheets in the bins 114 from being discharged into the stacker 131. Consequently, if the automatic stapling mode is not selected, the operator may manually remove the stacks of sheets stored in the bins 114.

The aforementioned respective modes are selected through a keyboard provided in the copying machine body 1.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. A sorting apparatus for sorting and stapling sheets discharged from an image forming apparatus, comprising:

a sorter having a plurality of sheet stores arranged vertically and sloping so that forward ends thereof, onto which the leading edges of sheets are placed, are higher than respective back ends thereof, onto which the trailing edges of sheets are placed;

a transport path disposed between said image forming apparatus and said sorter, for transporting sheets to said sorter;

a stapler provided adjacent to said back ends of said sheet storers, for stapling stacks of sheets stored in said sheet storers;

means for discharging the stacks of sheets from said sheet storers along the slope of said sheet storers;

a stacker for storing the stacks of sheets discharged by said sheet discharging means, said stacker being located beneath said transport path; and sheet stops provided at the back ends of said sheet storers and rotatable between a sheet stop position, in which said stops contact the trailing edges of the sheets, and a sheet discharge position, in which said stops allow the sheets to drop into said stacker, wherein said sheet discharging means rotates said sheet stops to discharge the stacks of sheet from said storers into said stacker.

2. An apparatus according to claim 1 further comprising a partition frame disposed between said sorter and said transporting path, against which the upper end of said sheet stops is able to contact, said partition frame having openings which permit the rotation of said sheet stops.

3. An apparatus according to claim 2 further comprising:

a shutter which shuts said openings in said partition frame; and means for driving said shutter to unblock and shut said opening.

4. An apparatus according to claim 2 further comprising stack guide disposed under said openings to guide the stacks of sheets dropping from said sheet storers into said stacker.

5. An apparatus according to claim 1 further comprising means for driving said sheet storers to move vertically.

6. An apparatus according to claim 1, wherein said stapler is located above said stacker.

7. An apparatus according to claim 1, wherein said stacker is located above said transport path.

8. An apparatus according to claim 7 further comprising a sheet folding device located under said transport path.

9. A sorting apparatus for sorting and stapling sheets discharged from an image forming apparatus, comprising:

a sorter having a plurality of sheet storers arranged vertically and sloping so that forward ends thereof, onto which the leading edges of sheet are placed, are higher than respective back ends thereof, onto which the trailing edges of sheets are placed;

a transport path disposed between said image forming apparatus and said sorter, for transporting sheets to said sorter;

a stapler provided adjacent to said back ends of said sheet storers, for stapling stacks of sheets stored in said sheet storers:

means for discharging the stacks of sheets from said sheet storers along the slope of said sheet storers, which includes a position changing mechanism for changing the position of said sheet storers in order to locate said forward ends lower than said back ends, and thereby permitting the stacks of sheets in said sheet storers to be discharged from said forward ends thereof; and a stacker for storing the stacks of sheets discharged by said sheet discharging means.

10. An apparatus according to claim 9, wherein said sorter has a main frame, a retainer for retaining said sheet storers, and a conveyance mechanism for vertically conveying said back ends of said sheet storers.

11. An apparatus according to claim 10, wherein said main frame includes a first side portion extending vertically adjacent to said back ends of said sheet storers, a second side portion extending vertically adjacent to said forward ends of said sheet storers, and a bottom portion interconnected with the lower portions of said first and second side portions.

12. An apparatus according to claim 11 further comprising:

a stack transport path provided in said second side portion for transporting the stacks of sheets discharged from said sheet storers downward; and a stacker provided in said bottom portion of said main frame for storing the stacks of sheets from said stack transport path.

13. An apparatus according to claim 9, wherein said position changing mechanism includes:

trunnions provided on either side of one end of said sheet storers; and screw-cams having outer surfaces provided with helical grooves into which said trunnions engage, and which by their rotation to vertically convey said back ends of said sheet storers by rotation.

14. A sorting apparatus for sorting and stapling sheets discharged from an image forming apparatus, comprising:

a sorter having a plurality of sheet storers arranged vertically and sloping so that forward ends thereof, onto which the leading edges of sheets are placed, are higher than respective back ends thereof, onto which the trailing edges of sheets are placed;

a transport path disposed between said image forming apparatus and said sorter, for transporting sheets to said sorter;

a stapler provided adjacent to said back ends of said sheet storers, for stapling stacks of sheets stored in said sheet storers;

means for discharging the stacks of sheets from said sheet storers along the slope of said sheet storers, which includes a discharge path provided in the wall of said sorter adjacent to said transport path and sloping in parallel with said sheet storers, and a scraper for scraping out a stack of sheets from each of said sheet storers into said discharge path by lifting said stack; and a stacker for storing the stacks of sheets discharged by said sheet discharging means.

15. An apparatus according to claim 14, wherein said sheet discharging means operates only when the stacks of sheets in said sheet storers have been stapled.

16. An apparatus according to claim 14, wherein said stacker is located above said transport path.

17. An apparatus according to claim 14, further including a sheet folding device located under said transport path.

18. A sorting apparatus for sorting and stapling sheets discharged from an image forming apparatus, comprising:

a plurality of sheet storers vertically conveyable for storing sheets supplied from said image forming apparatus;

means for driving said sheet storers;

a stapler for stapling said sheets stored in said sheet storers;

a pair of lateral guides movable in the sheet width direction in said sheet storers which abut on either sides of the sheets in order to arrange the sheets in the width direction and to move the stacks of sheets into the stapling position of said stapler; and means for driving said lateral guides.

19. An apparatus according to claim 18, wherein said stapler is located in a position to one side of the trailing edges of the sheets, adjacent to one of said lateral guides such that it is not an obstacle to the vertical movement of said sheet storers.

20. An apparatus according to claim 19, wherein each of said sheet storers includes a main tray, and a slidable tray provided at an end of said main tray adjacent to the trailing edges of the sheets and slidable in the sheet width direction.

21. An apparatus according to claim 20 further comprising means for impelling said slidable tray away from said stapler, whereby said slidable tray in its free state is centered along the width direction of a sheet.

22. An apparatus according to claim 20, wherein the dimension in the sheet width direction of said slidable tray is less than the minimum size of sheets utilizable in said sorter.

23. An apparatus according to claim 21, wherein each of said lateral guides includes a contact which abuts on the corresponding sides of the sheets, and a guide portion for guiding the movement of said contact.

24. An apparatus according to claim 23 further comprising guide pins fixed to the main frame, wherein said guide portions of said guides extend in the sheet width direction and have guide slots extending likewise and slidably fitted onto said guide pins.

25. An apparatus according to claim 19, wherein the movement of each of said lateral guides is independently controlled by said lateral guide drive means.

26. An apparatus according to claim 25, wherein said guide portion of each side guide has a rack extending in the sheet width direction; and said lateral guide drive means includes two pinions engaging with said racks and two motors for driving said pinions.

27. An apparatus according to claim 18, wherein said sheet storers are sloped such that respective forward ends thereof, whereon leading edges of sheets are placed, are higher than respective back ends thereof, whereon trailing edges of sheets are placed, and wherein said apparatus further comprises:

means for discharging stacks of sheets from said sheet storers along the slope of said sheet storers; and a stacker for storing the stacks of sheets discharged by said sheet discharging means.

28. An apparatus according to claim 27, further comprising a transport path for transporting sheets between said image forming apparatus and said sheet storers wherein said stacker is located under said transport path.

29. An apparatus according to claim 27, wherein said sheet discharging means includes:

a sheet stop provided at the back ends of said sheet storers rotatable between a sheet stop position wherein said stops are in contact with the sheet ends and a sheet discharge position wherein said stops allow the sheets to drop into said stacker; and means for rotating said sheet stop.

30. A stapling apparatus for sorting and stapling sheets discharged from an image forming apparatus, comprising:

a sheet storer for storing said sheets;

means for stapling said sheets in said sheet storer, a pair of lateral guides movable in the sheet width direction in said sheet storer so as to abut either side of said sheets for properly arranging sheet stacks, and for moving said stack into the stapling position of said stapling means; and means for driving said lateral guides.

31. An apparatus according to claim 30, wherein said sheet storer slopes such that the forward end thereof, whereon leading edges of the sheets are placed, is higher than the back end thereof, whereon trailing edges of the sheets are placed, and said apparatus further comprises:

means for discharging the stack of sheets from said sheet storer along the slopes of said sheet storer; and a stacker for storing the stacks of sheets discharged from said sheet discharging means.

32. An apparatus according to claim 30, wherein the movement of either of said lateral guides is independently controlled by said lateral guide drive means.

* * * * *